US006759650B2

(12) United States Patent
Covey et al.

(10) Patent No.: US 6,759,650 B2
(45) Date of Patent: Jul. 6, 2004

(54) METHOD OF AND APPARATUS FOR IONIZING AN ANALYTE AND ION SOURCE PROBE FOR USE THEREWITH

(75) Inventors: Thomas R. Covey, Richmond Hill (CA); Raymond Jong, Toronto (CA); Hassan Javaheri, Richmond Hill (CA)

(73) Assignee: MDS Inc., Concord ( * ) Notice: Subject to any disclaimer, the term of this patent is extended or adjusted under 35 U.S.C. 154(b) by 0 days.

(21) Appl. No.: 10/118,343

(22) Filed: Apr. 9, 2002

(65) Prior Publication Data

US 2003/0189170 A1 Oct. 9, 2003

(51) Int. Cl.[7] ..... H01J 49/00; H01J 49/04

(52) U.S. Cl. ..... 250/288; 250/282; 250/423 R; 250/424; 250/425

(58) Field of Search ..... 250/281–300, 250/423 R, 424, 425

(56) References Cited

U.S. PATENT DOCUMENTS

| | | | | |
|---|---|---|---|---|
| 4,861,988 A | | 8/1989 | Henion et al. | |
| 4,982,097 A | * | 1/1991 | Slivon et al. | 250/288 |
| 5,412,208 A | * | 5/1995 | Covey et al. | 250/288 |
| 5,753,910 A | | 5/1998 | Gourley et al. | |
| 6,177,669 B1 | * | 1/2001 | Wells et al. | 250/288 |
| 6,201,955 B1 | * | 3/2001 | Jasper et al. | 455/277.2 |
| 2003/0189169 A1 | * | 10/2003 | Wells et al. | 250/288 |

FOREIGN PATENT DOCUMENTS

WO WO 00/19484 4/2000

OTHER PUBLICATIONS

W.M.A. Niessen, U.R. Tjaden and J. Van De Greef, Strategies in Developing Internfaces for Coupling Liquid Chromatogratphy and Mass Spectrometry; Journal of Chromatography, 554 (1991) Aug. 21, Nos. 1/2. Amsterdam, NL.

Jan Schelling, Lothar Reh; Influences of Atomiser Design and Coaxial Gas Velocity on Gas Entrainment Into Sprays; Chemical Engineering and Process 38 (1999) 282–393.

* cited by examiner

*Primary Examiner*—Nikita Wells
*Assistant Examiner*—Christopher M. Kalivoda
(74) *Attorney, Agent, or Firm*—Bereskin & Parr

(57) ABSTRACT

Ions for analysis are formed from a liquid sample comprising an analyte in a solvent liquid by directing the liquid sample through a capillary tube having a free end so as to form a first flow comprising a spray of droplets of the liquid sample, to promote vaporization of the solvent liquid. An orifice member is spaced from the free-end of the capillary tube and has an orifice therein. An electric field is generated between the free-end of the capillary and the orifice member, thereby causing the droplets to be charged, and the first flow is directed in a first direction along the axis of the capillary tube. Two gas sources, or an arc jet of gas, provide second and third flows, of a gas, and include heaters for heating the second and third flows. The second and third flows intersect with the first flow at a selected mixing region, to promote turbulent mixing of the first, second and third flows, the first, second and third directions being different from one another, and each of the second and third directions being selected to provide each of the second and third flows with a velocity component in the first direction and a velocity component towards the axis of the capillary tube, thereby to promote entrainment of the heated gas in the spray, with the heated gas acting to assist the evaporation of the droplets to release ions therefrom. At least some of the ions produced from the droplets are drawn through the orifice for analysis.

39 Claims, 14 Drawing Sheets

METHOD OF AND APPARATUS FOR IONIZING AN ANALYTE AND ION SOURCE PROBE FOR USE THEREWITH

FIELD OF THE INVENTION

This invention relates to a method and apparatus for forming ions from an analyte, more particularly for forming ions from an analyte dissolved in a liquid. Usually, the generated ions are directed into a mass analyzer, typically a mass spectrometer. The present invention also relates to an ion source probe use in such a method or apparatus.

BACKGROUND OF THE INVENTION

There are presently available a wide variety of mass spectrometer and mass analyzer systems. A common and necessary requirement for any mass spectrometer is to first ionize an analyte of interest, prior to introduction into the mass spectrometer. For this purpose, numerous different ionization techniques have been developed. Many analytes, particularly larger or organic compounds, must be ionized with care, to ensure that the analyte is not degraded by the ionization process. A commonly used ion source is an electrospray interface, which is used to receive a liquid sample containing a dissolved analyte, typically from a source such as a liquid chromatograph ("LC"). Liquid from the LC is directed through a free end of a capillary tube connected to one pole of a high voltage source, and the tube is mounted opposite and spaced from an orifice plate connected to the other pole of the high voltage source. An orifice in the orifice plate leads, directly or indirectly, into the mass analyzer vacuum chamber. This results in the electric field between the capillary tube and the orifice plate generating a spray of charged droplets producing a liquid flow without a pump, and the droplets evaporate to leave analyte ions to pass through the orifice into the mass analyzer vacuum chamber.

Electrospray has a limitation that it can only handle relatively small flows, since larger flows produce larger droplets, causing the ion signal to fall off and become unstable. Typically, electrospray can handle flows up to about 10 microlitres per minute. Consequently, this technique was refined into a technique known as a nebulizer gas spray technique, as disclosed, for example, in U.S. Pat. No. 4,861,988 to Cornell Research Foundation. In the nebulizer technique, an additional co-current of high velocity nebulizer gas is provided co-axial with the capillary tube. The nebulizer gas nebulizes the liquid to produce a mist of droplets which are charged by the applied electric field. The gas serves to break up the droplets and promote vaporization of the solvent, enabling higher flow rates to be used. Nebulizer gas spray functions reasonably well and liquid flows of up to between 100 and 200 microlitres per minute. However, even with the nebulizer gas spray, it has been found that with liquid flows of the order of about 100 microlitres per minute, the sensitivity of the instrument is less than at lower flows, and that the sensitivity reduces substantially for liquid flows above about 100 microlitres per minute. It is believed that at least part of the problem is that at higher liquid flows, larger droplets are produced and do not evaporate before these droplets reach the orifice plate. Therefore, much sample is lost.

Another attempt to improve on the nebulizer technique is disclosed in U.S. Pat. No. 5,412,208 to Thomas R. Covey, one of the inventors of the present invention, and Jospeh F. Anacleto, (and assigned to this same assignee of the present invention). This patent discloses an ion spray technique that is now marketed under the trademark TURBOION SPRAY, and has enjoyed some considerable success. The basic principle behind this technique, which was developed as an improvement on the earlier nebulizer technique, is to provide a flow of heated gas in a second direction, at an angle to the direction of the basic nebulizer tube, so that the flow of heated gas intersects with the spray generated from the tip of a nebulizer tube. This intersection region is located upstream of the orifice, causing the flows to mix turbulently, whereby the second flow promotes evaporation of the droplets. It is also believed that the second flow helps move droplets towards the orifice, providing a focusing effect and providing better sensitivity. It is also mentioned in this patent that the flows could be provided opposing one another and perpendicular to the axis through the orifice. The intention is that the natural gas flow from the atmospheric flow pressure ionization region into the vacuum chamber of the mass analyzer would draw droplets towards the orifice and hence promote movement of ions into the mass analyzer.

This U.S. Pat. No. 5,412,208 also proposes the use of a second heated gas flow or jet. The only specific configuration mentioned is to provide a first gas flow opposed to the nebulizer, with both this gas flow and the nebulizer perpendicular to the orifice, and then provide a second gas flow aligned with the axis of the orifice, so as to be perpendicular to the nebulizer and the first gas chamber. However, this arrangement is not discussed in any great detail, and indeed the patent specifically teaches that it is preferred to use just one gas flow, so as to avoid the complication of balancing three gas flows (the two separate gas flows and the gas flow required for the nebulizer). It also teaches that by suitably angling the tubes with just one gas jet, a net velocity component towards the orifice can be provided, without the requirement of a second, separate heated gas flow.

Further research by the inventors of the present application has revealed many short comings with this arrangement. Firstly, heaters previously used to heat the gas flow have proved inadequate and did not provide good heat exchange efficiency. Consequently, the gas is not heated to an optimum temperature. This deficiency was compounded by the manner in which the feed-back sensor was implemented; the set temperature is far higher than the gas temperature, as the set temperature is a measure of the heater temperature and not the gas temperature. The previous arrangements described in U.S. Pat. No. 5,412,208 provided a gas flow on just one side of the spray cone emitted from the nebulizer, which resulted in asymmetric heating and heat starvation. Typically, the axis of the nebulizer was directed to one side of the orifice, and the heated gas was then directed to the nebulizer spray on a side away from the orifice. This meant that heat did not penetrate sufficiently to the region of the spray adjacent the sampling orifice, so that droplets in the best position for generating ions for passage through the orifice were not adequately heated and desolvated. Hence, it was difficult to achieve maximum desolvation, especially at high flow rates. As the spray was sampled on the side opposite from the gas jet, a substantial amount of surrounding air is drawn in to the spray; in other words, rather ensuring that gas sampled through the orifice is a clean gas with a known composition, with this arrangement there is a tendency for ambient air to mix in with the spray. This draining in and mixing in of surrounding air or gas is entrainment, and this can contribute to high background levels. In order to provide good sensitivity, the spray was directed, if not directly at the orifice, to a location adjacent the orifice. This results in a high probability for larger drops to penetrate the curtain gas provided on the other side of the orifice, and these can then contribute to background noise levels.

In conventional ion sources, e.g. as in U.S. Pat. No. 5,412,208, large volumes of gas are drawn into the ionization region by the entrainment effect. Commonly, the composition of this external gas is uncontrolled, so that the gas is contaminated with chemical entities constituting chemical noise. Common and ubiquitous materials such as phthalates (plastics components) are present at high levels in all sources of gasses except those of a highly purified nature such as the entrainment gas of the present invention. While U.S. Pat. No. 5,412,208 does inject clean gas, it is ineffective, because it is asymmetrically injecting the gas on the wrong side., i.e. away from the orifice.

An important factor that is not even recognized in the earlier '208 patent is that of the effect on performance on entrainment and recirculation. An expanding spray cone tends always to entrain surrounding gas, causing the cross-section of the spray cone to progressively increase and the mass flow rate to progressively increase; simultaneously, as surrounding gas is entrained, the average velocity of the spray cone tends to decrease. In an ionization chamber, this means that the gas in the chamber is entrained with the spray cone. As the spray is discharged within the chamber, remnants from the spray build-up within the gas, and are then recirculated back into the spray cone. This has a number of serious disadvantages. On the one hand, it gives a memory effect where, if the analyte in the spray is switched, the remaining spray in the ionization chamber containing a previous analyte still recirculates the prior analyte for some time. The result is that, in the ions stream entering the mass spectrometer, one does not observe a clean, abrupt switch from one analyte to the other, but rather the level of the previous analyte tends to trail off somewhat. Also, it can lead to build-up of solvents and other unwanted material within the spray chamber, increasing background chemical noise level.

SUMMARY OF THE INVENTION

In accordance with a first aspect of the present invention, there is provided a method of forming ions for analysis from a liquid sample comprising an analyte in a solvent liquid, the method comprising the steps of:

a) providing a capillary tube having a free end, and an orifice member spaced from the free-end of the capillary tube and having an orifice therein;

b) directing the liquid through the capillary tube and out the free-end, to form a first flow comprising a spray of droplets of the liquid sample, to promote vaporization of the solvent liquid;

c) generating an electric field between the free-end of the capillary and the orifice member, and thereby causing the droplets to be charged, and directing the first flow in a first direction along the axis of the capillary tube;

d) providing second and third flows, of a gas, and heating the second and third flows;

e) directing the second and third flows to intersect with the first flow at a selected mixing region, to promote turbulent mixing of the first, second and third flows, the first, second and third directions being different from one another, and each of the second and third directions being selected to provide each of the second and third flows with a velocity component in the first direction and a velocity component towards the axis of the capillary tube, thereby to promote entrainment of the heated gas in the spray, with the heated gas acting to assist the evaporation of the droplets to release ions there from;

drawing at least some of the ions produced from the droplets through the orifice for analysis.

In accordance with a second aspect of the present invention, there is provided a method of forming ions for analysis from a liquid sample comprising an analyte in a solvent liquid, the method comprising the steps of:

a) providing a capillary tube having a free end, and an orifice member spaced from the free-end of the capillary tube and having an orifice therein;

b) directing the liquid through the capillary tube and out the free-end, to form a first flow comprising a spray of droplets of the liquid sample, to promote vaporization of the solvent liquid;

c) generating an electric field between the free-end of the capillary and the orifice member, and thereby causing the droplets to be charged, and directing the first flow in a first direction along the axis of the capillary tube;

d) providing a continuous arc jet, of a gas, extending in an arc at least partially around the axis of the capillary tube and heating the arc jet of gas;

e) directing the arc jet of gas to intersect with the first flow at a selected mixing region, to promote turbulent mixing of the first flow and the arc jet of gas, all of the arc jet of gas being directed at an angle to the first direction, said angle being selected to provide all of the arc jet of gas with a velocity component in the first direction and a velocity component towards the axis of the capillary tube, thereby to promote entrainment of the heated gas in the spray, with the heated gas acting to assist the evaporation of the droplets to release ions therefrom;

f) drawing at least some of the ions produced from the droplets through the orifice for analysis.

It is to be noted that the arc jet of gas can be part of a circle, a semi-circle, or even a complete circle and it can be provided by a number of discrete jets or by one continuous jet. It is preferred that the outlets forming the gas jets be space radially outwardly away from the nebuliser or other outlet for the sample.

In accordance with a third aspect of the present invention, there is provided an apparatus for generating ions for analysis from a sample liquid containing an analyte, the apparatus comprising:

a) an ion source housing defining an ion source chamber;

b) a capillary tube, for receiving the liquid and having a first free end in the chamber for discharging the liquid into the chamber as a first flow comprising a spray of droplets;

c) an orifice member in the housing and having an orifice therein providing communications between the ion source chamber and the exterior thereof, the orifice being spaced from the free end of the capillary tube;

d) connections for the capillary tube and the orifice member, for connection to a power source, to generate an electric field between the free end of the capillary tube and the orifice member; and e) two gas sources, each gas source comprising a heater for the gas and a gas outlet, for generating second and third flows, of gas, wherein the second and third flows are directed to intersect with the first flow at a selected mixing region for turbulent mixing of the first, second and third flows, the first, second and third directions being different from one another, and each of the second and third directions providing the second and third flows with a velocity component in the first direction and a velocity component towards the axis of the capillary tube, whereby in use, the spray formed from the first flow turbulently mixes with heated gas of the second and third flows in the selected region, to promote evaporation of droplets of the liquid in the first flow to release ions therefrom and whereby the ions pass through the orifice for analysis.

In accordance with a fourth aspect of the present invention, there is provided an apparatus for generating ions for analysis from a sample liquid containing an analyte, the apparatus comprising:

a) an ion source housing defining an ion source chamber;

b) a capillary tube, for receiving the liquid and having a first free end in the chamber for discharging the liquid into the chamber as a first flow comprising a spray of droplets;

c) an orifice member in the housing and having an orifice therein providing communications between the ion source chamber and the exterior thereof, the orifice being spaced from the free end of the capillary tube;

d) connections for the capillary tube and the orifice member, for connection to a power source, to generate an electric field between the free end of the capillary tube and the orifice member;

e) a gas source, comprising a heater for the gas and an arc-shaped gas outlet, for generating an arc jet, of gas, wherein the arc jet is directed at an angle to the first direction, to intersect with the first flow at a selected mixing region for turbulent mixing of the first flow and the arc jet of gas, the angle being such as to provide all of the gas of said arc jet with a velocity component in the first direction and a velocity component towards the axis of the capillary tube, whereby in use, the spray formed from the first flow turbulently mixes with heated gas of the arc jet in the selected region, to promote evaporation of droplets of the liquid in the first flow to release ions therefrom and whereby the ions pass through the orifice for analysis.

Again, the gas outlet can be a single jet or a plurality of discrete jets, and the arc shape can encompass any angle from less than a semi-circle to a full circle.

In accordance with a fifth aspect of the present invention, there is provided an apparatus for generating ions from a liquid sample comprising a solvent liquid and an analyte dissolved therein, the apparatus comprising:

a) an ion source housing defining an ion source chamber;

b) at least one ion source within the ion source housing for generating a spray of droplets of the liquid sample;

c) an orifice member in the ion source housing having an orifice therein and being spaced from the ion source;

d) connections for connecting the orifice member and the ion source to a power supply for generating an electric field therebetween;

e) at least one gas source having a heater and a gas outlet, each gas source being mounted in the ion source housing and being directed in a direction towards a selection mixing region, to promote turbulent mixing of the spray and the gas;

f) a primary exhaust outlet in the ion source housing located adjacent and downstream from the selected region, to reduce recirculation of spent gas and liquid sample within the ion source housing.

The primary exhaust outlet can be provided by a tube extending into the housing and/or by a modification to the housing bringing the bottom (assuming that as is conventional the ion source is mounted in the top facing downwards) of the housing closed to the orifice for ions.

In accordance with a sixth aspect of the present invention, there is provided an atmospheric pressure chemical ionization source comprising:

a) a tubular ceramic body defining a substantially tubular flash desorption chamber, opened at one end and closed at the other end;

b) a supply tube extending through the closed end of the body to provide at least a spray of a liquid sample containing an analyte dissolved in a solvent liquid; and c) an electrical resistive heating element formed within the ceramic for heating the ceramic to a temperature sufficient to cause flash vaporization of droplets of the liquid sample.

This heater configuration is well suited for implementing another aspect of the present invention, although generally this can be implemented with any suitable heater. This provides, preferably as part of an ion source housing, a heater, preferably tubular, configured to accept either a nebuliser probe or an APCI probe. A probe for a corona discharge is preferably movably mounted adjacent an outlet of the heater. For a nebuliser probe, the heater acts just as a holder and the outlet of the nebuliser probe would be located close to the outlet of the heater. For the APCI probe, the actual probe would have its outlet located within the heater so that the spray therefrom is heated etc. by the heater, which is then actuated. The APCI probe preferably has no auxiliary gas flow so as to have an outside diameter that can generally correspond to that for the nebuliser probe.

Finally, corresponding to the sixth aspect above, a seventh aspect of the present invention provides a method of forming ions by atmospheric chemical pressure ionization, the method comprising:

a) providing a capillary tube with a free end for forming a spray from a liquid sample comprising a solvent liquid and an analyte dissolved therein;

b) providing a flow of a gas to promote evaporation of the solvent liquid;

c) providing a heated surface around the spray and heating the surface to a temperature sufficient to promote flash vaporization of liquid droplets and prevent substantial contamination of the heater surface by the Leidenfrost effect;

d) providing a corona discharge to ionize free analyte molecules.

BRIEF DESCRIPTION OF THE DRAWINGS

For a better understanding of the present invention and to show more clearly how it may be carried into effect, reference will now be made, by way of example, to the accompanying drawings, which show a preferred embodiment of the present invention and in which.

DETAILED DESCRIPTION OF THE INVENTION

Figure 1:
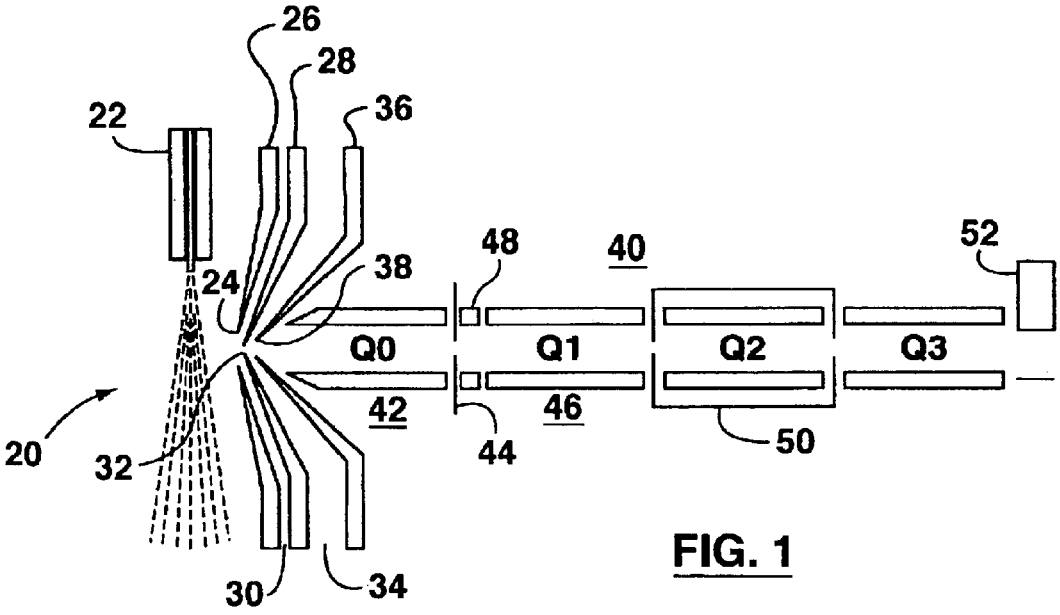
FIG. 1 is a schematic view of the triple quadrupole mass spectrometer incorporating the present invention.
Figure 2:
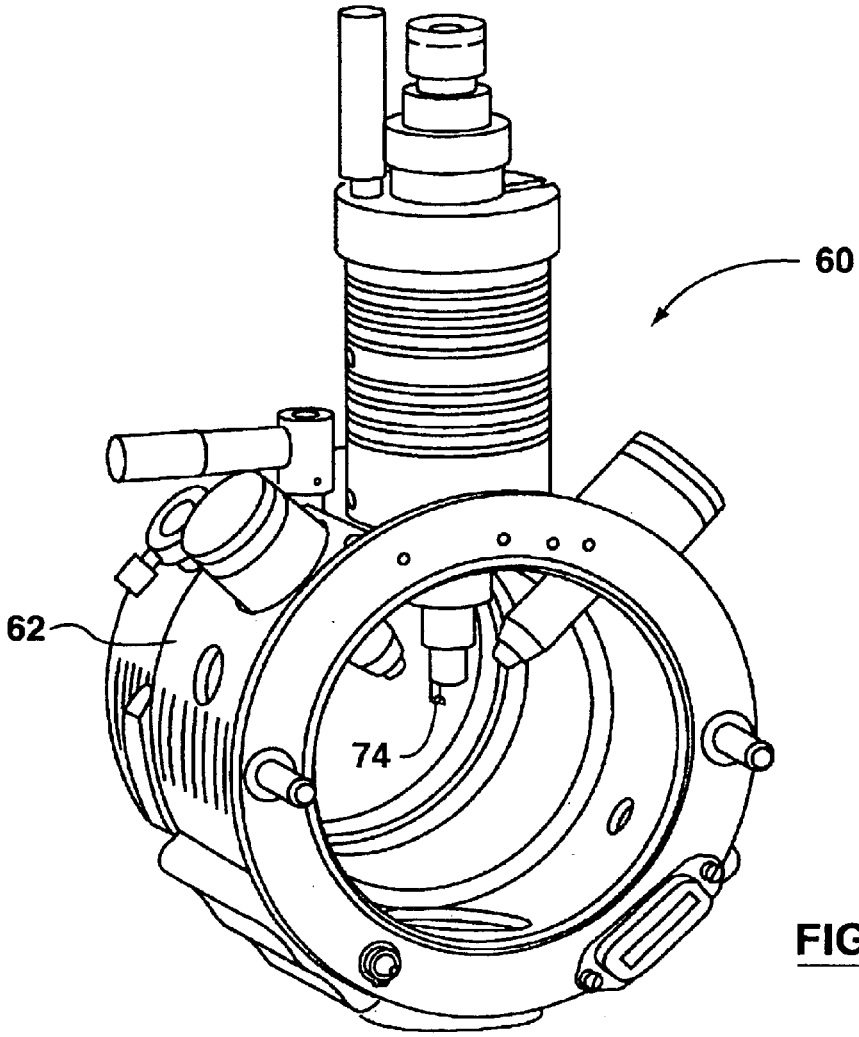
FIG. 2 is a perspective view of an ion source in accordance with the present invention.

Referring first to FIG. 1, there is shown schematically the basic configuration of a typical quadrupole mass spectrometer incorporating the present invention. However, as detailed below, it is to be appreciated that the invention is not limited to the particular spectrometer configuration as shown. As it will also be understood by someone skilled in this art, FIG. 1 shows the basic elements within a mass spectrometer, but does not show many of the standard external features. Thus, the external housing is not shown, and pumps, power supplies and the like necessary for operation of the spectrometer are also not shown. In FIG. 1, a spray chamber 20 includes a nebulizer ion spray source 22. As shown, the nebulizer is arranged with its axis directed across and spaced from a curtain orifice 24 in a curtain plate 26.

Between the curtain plate 26 and an orifice plate 28, there is a curtain gas chamber 30 operable in known manner, to provide gas flow through the curtain gas chamber and out through the orifice 24, so as to remove solvent vapour and neutrals penetrating through into the curtain gas chamber.

A main orifice 32 in the orifice plate 28 provides passage through to an intermediate pressure chamber 34. A skimmer plate 36 includes a skimmer orifice 38, separating the intermediate pressure chamber 34 from the main spectrometer chambers indicated generally at 40.

An inlet chamber 42 of the mass spectrometer includes a rod set Q0, intended to focus ions and promote further removal of remaining gas and vapour.

A plate 44 includes an interquad aperture and provides an interface between the inlet chamber 42 and a chamber 46 containing first and second mass analyzing rod sets Q1 and Q3. As indicated at 48, a Brubaker lens can be provided to further assist in focusing the ions. Also located within the chamber 46 is a collision cell 50, containing rod set Q2, located between Q1 and Q3. Finally, at the outlet of Q3, a detector 52 is provided for detecting ions.

In known manner, ions from the ion source 22 pass through the curtain gas chamber 30 and intermediate pressure chamber 34 into the spectrometer inlet chamber 42. From there, the ions pass through to Q1 in chamber 46, for selection of a parent ion. The parent ions are subject to fragmentation and/or reaction in Q2 and the resultant fragment or other ions are scanned in Q3 and detected by the detector 52.

As noted, the present invention is not limited to the particular triple quadrupole configuration shown (the three quadrupoles, Q1, Q2, Q3 conventionally comprise the triple quadrupole necessary for implementing MS/MS analysis). For example, it is known to replace the final mass analyzer provided by the quadrupole rod set Q3 and the detector 52 with a time of flight analyzer, this having the known advantage of not being a scanning section and enabling all ions to be analyzed simultaneously. The mass spectrometer can also include any other known analyzers, for example ion traps, fourier transform mass spectrometers, time of flight mass spectrometers.

Figure 3:
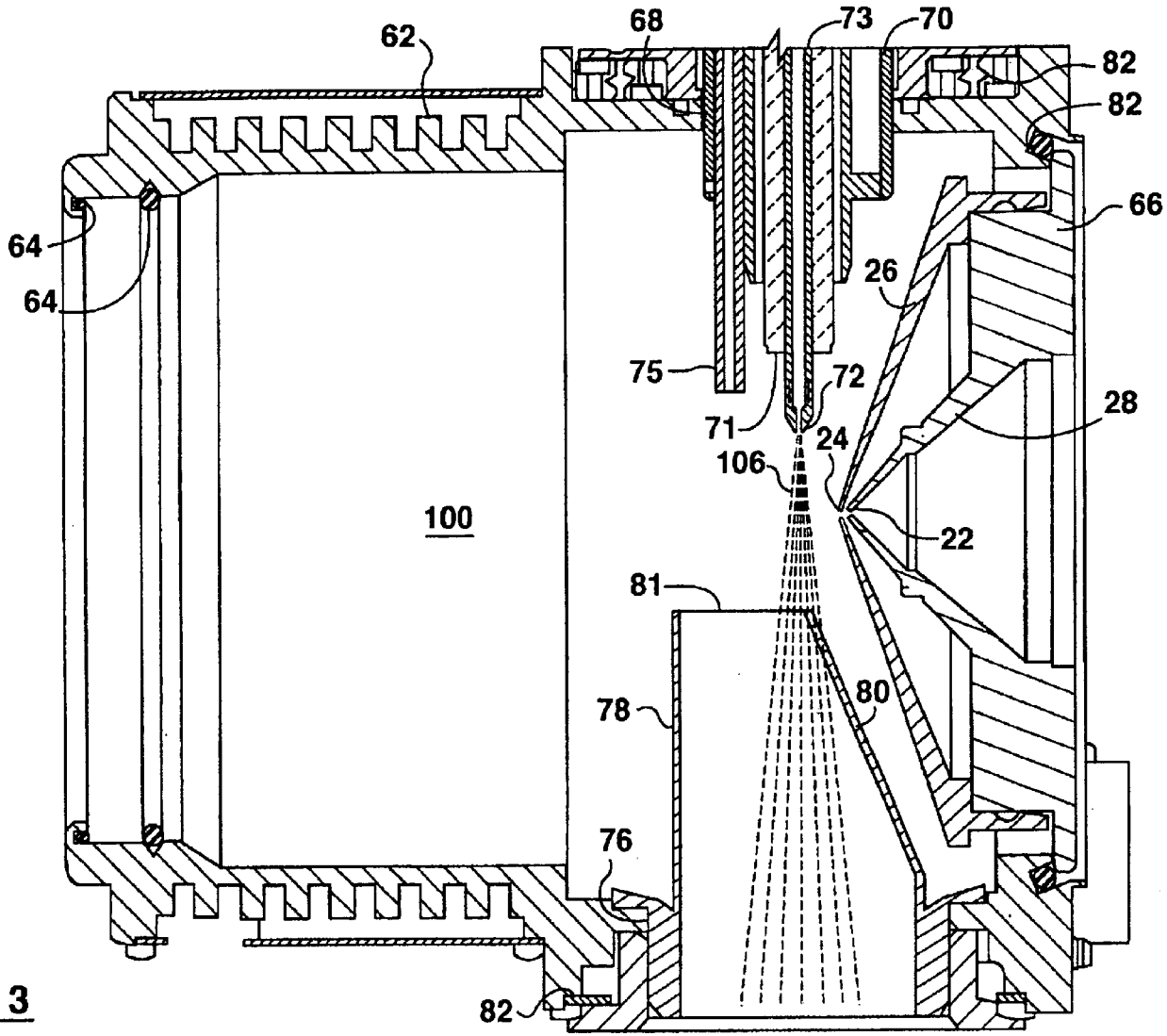
FIG. 3 is a vertical sectional view through the ion source of FIG. 2.

Reference will now be made to FIGS. 2–7 which show in detail an ion source in accordance with the present invention, here identified as 60, and configured for replacing the nebulizer ion source 22 of a conventional triple quadrupole instrument. The ion source 60 has a source housing 62, which is generally cylindrical and defines an ion source chamber 100. As shown in FIG. 3, the source is provided with a pair of ring seals 64 for a closure (not shown). At the other end, an interface 66 includes the curtain plate 26 and orifice plate 28, with their respective curtain orifice 24 and main orifice 32.

Figure 6:
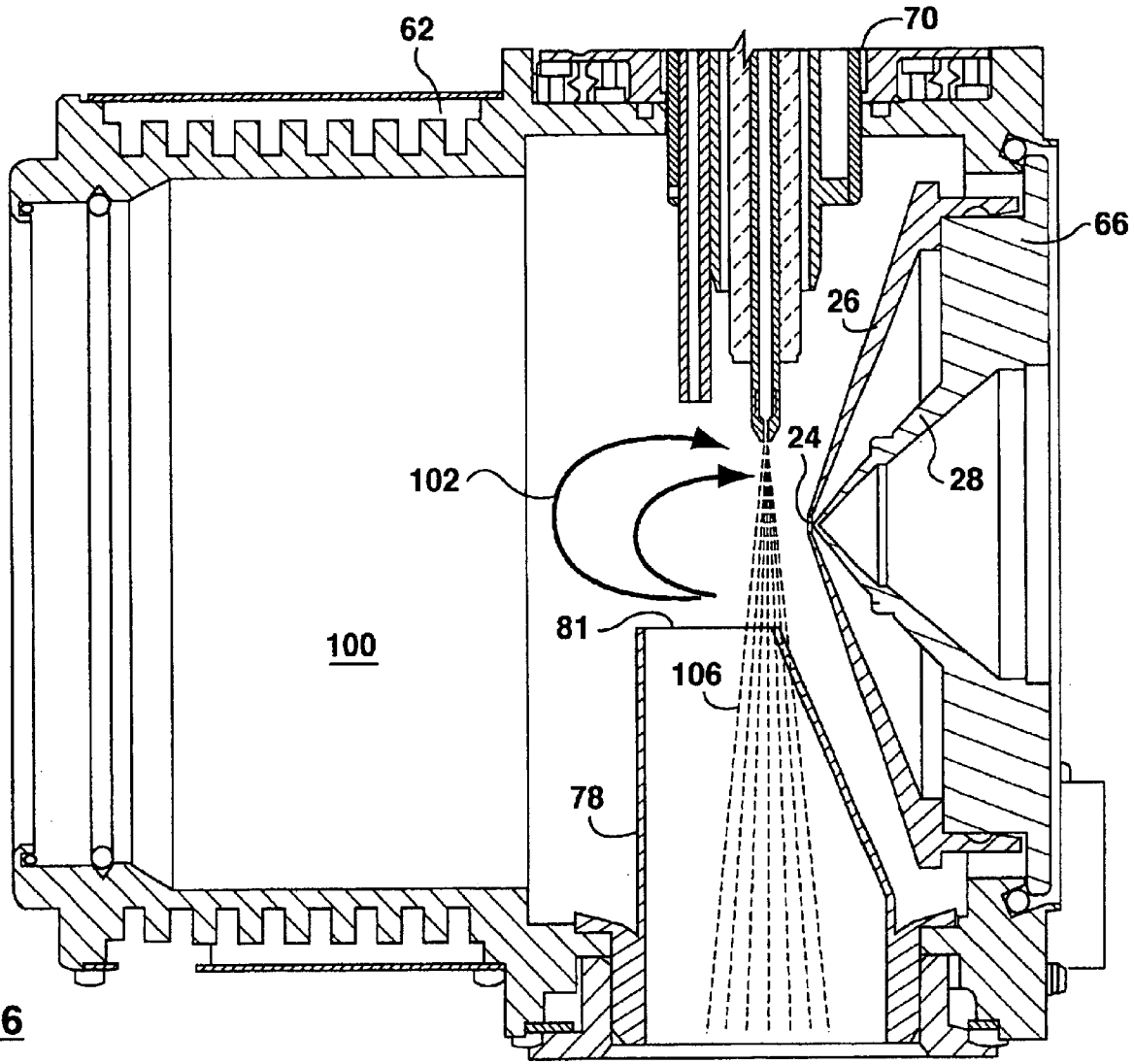
FIG. 6 is a vertical sectional view similar to FIG. 3, showing reduced recirculation with an exhaust extension tube.

In accordance with the present invention, the top of the housing 62 is provided with an aperture 68, in which there is a probe heater 70, for mounting ion source probes. Here, the invention is shown with a nebulizer source probe 72, which in known manner includes a central capillary tube and an annular chamber around the capillary tube for providing an annular flow of gas around the capillary tube. The nebulizer source probe 72 should point to the nozzle directly above the spray cone 106. The spray cone 106 is the nebulized aerosol of charged droplets and gas emitting from the nebulizer source probe 72. The central capillary tube of the nebulizer source is not shown but the annular chamber around the capillary tube for providing an annular flow of gas is shown (FIGS. 3 and 6). A nebulizer outlet is shown at 73, for the combined gas and liquid sample flow. A heater for an atmospheric pressure chemical ionization (APCI) source probe is shown at 71, and includes an internal bore that enables an APCI source probe or a nebulizer probe to be inserted, as detailed below. For use with an APCI source, there is provided any required discharge probe indicated at 74 in FIG. 2, and mounted in a tube 75 shown in FIG. 3.

The heater 71 performs two distinct and separate functions that have the effect of enabling the ion source 60 to be a dual purpose ion source that can be fitted with either a nebuliser ion source probe or an APCI ion source probe. For a nebuliser ion source probe the heater just functions as a holder or receptacle and is not operated as a heater; the discharge probe 74 is pivoted out of the way. For APCI use, the nebuliser ion source is removed and replaced with an APCI source, as will be detailed below. The discharge probe 74 is pivoted into its operative position and the heater 71 is operated to heat the spray from the APCI source. this arrangement has many advantages to users. It enables the two types of sources to be interchanged quickly and simply. It avoids the need for a user to purchase two different complete ion source assemblies, and these are quite costly.

As shown, the nebulizer source probe 72 is arranged with its axis perpendicular to the axis of the interface 66 and spaced from the first, curtain orifice 24 and is directed towards an exhaust outlet 76, on the diametrically opposite side of the housing 62.

The exhaust outlet 76 comprises an aperture in the housing 62. Mounted with this exhaust outlet is an inner exhaust guide tube 78. As shown, the exhaust guide tube 78 is generally cylindrical, and one side is cut away at an angle, corresponding, generally, to the conical angle of the curtain plate 26, as indicated at 80. The end of the tube 78 nearest the probe 72 also provides a primary exhaust outlet 81. As the housing will be at a different potential from the curtain plate 26, it is necessary to maintain a spacing between these two elements to provide the necessary degree of electrical installation.

In known manner, the various elements will be mounted and secured to the housing 62 and provided with seals. Additional seals are indicated at 82.

Figure 4:
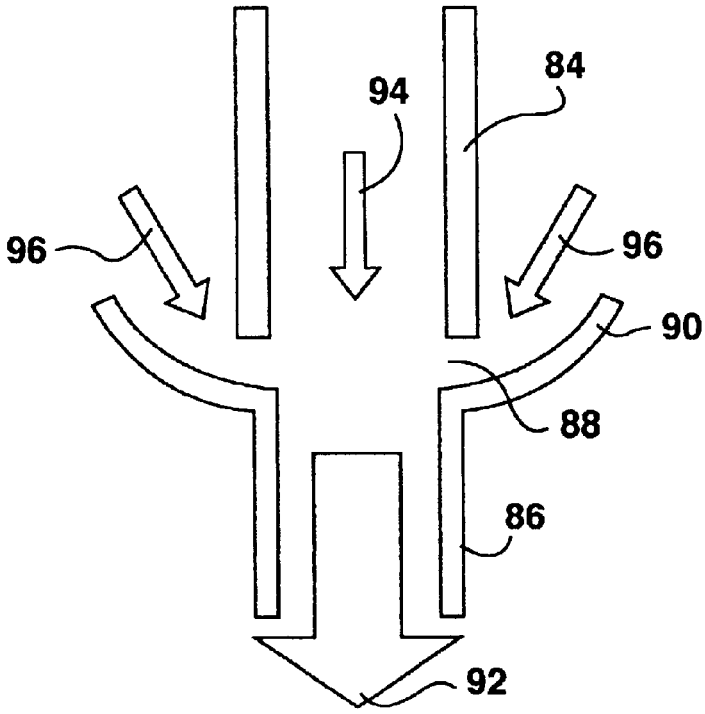
FIG. 4 is a schematic view of part of the ion source for FIGS. 2 and 3 showing details of exhaust outlet.

Referring now to FIG. 4, there is shown schematically further details of the exhaust arrangement. Although not shown in FIG. 3, an intermediate exhaust tube 84 extends from the inner exhaust guide tube 78. Co-axial with this intermediate exhaust tube 84 is an outer exhaust tube 86, spaced from the intermediate exhaust tube 84 to leave an annular gap 88. As shown, a curved, annular flange 90 extends generally radially outwards from the end of the outer exhaust tube 86, adjacent the annular gap 88, and opposite a secondary exhaust outlet at the end of the intermediate tube 84.

In use, this arrangement functions to maintain a substantially constant pressure, close to atmospheric pressure within the ion source chamber 100. As indicated by the large arrow 92, a pump (not shown) connected to the outer exhaust tube 86 draws air out of the tube 86 at a substantially constant rate. This air is supplied by flows indicated by the arrows 94 and 96, the arrow 94 indicating flow from the ion source chamber 100 through the inner and intermediate exhaust tubes 78, 84. The arrows 96 indicate ambient, room air drawn in through the annular gap 88. However in use, when gas is supplied to the ion source chamber 100 then there will be a substantial flow through the intermediate exhaust tube 84, and the amount of ambient air entrained in the flow through the annular gap 88 will be low. However, when the gas flow into the ion source chamber 100 is low, the annular gap 88 serves to enable the flow required through the average exhaust tube 86 to be made up by the surrounding room air. This ensures that, when no gas is supplied to the ion source chamber 100, the pressure with the chamber 100 is not, undesirably, drawn down to a low level. Thus, the two flows indicated by arrows 94, 96 balance one another.

The source housing 62 has integrated components, designed to be common for both a nebulizer spray and atmospheric chemical ionization probes. As detailed below, this makes changing sources simple and quick. The heater 71 is installed for the APCI source and is turned off when a nebulizer probe is used. It is provided with a plain cylindrical bore adapted to take either a nebulizer ion source or an APCI ion source An APCI source needle or probe 74 is fixed, with respect to the APCI desorption heater, but can be swung out of the way when a nebulizer spray probe is installed.

Figure 5A:
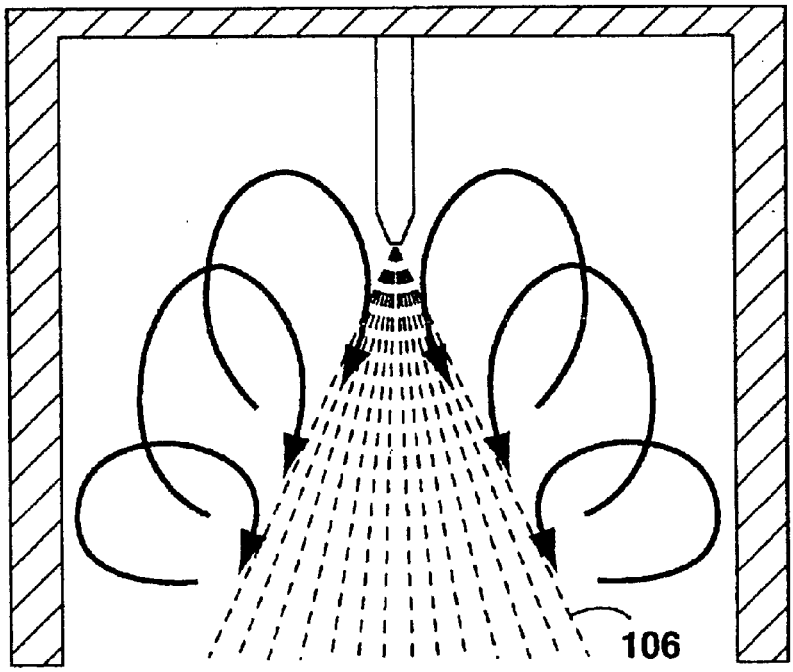
FIG. 5*a* is a schematic view showing entrainment and recirculation effects.

Reference will now be made, to FIG. 5*a*, which shows the problems of entrainment and recirculation. Entrainment in sprays is defined as the quantity of ambient gas which is drawn into a spray as the spray expands downstream from a nozzle. When a spray develops in a stagnant environment, forward momentum is transferred from the gas or fluid ejected into the spray. This increases the total flow rate of the spray while reducing the average velocity. Typically, the spray expands by a factor of 4–20 times the initial flow rate as it expands downstream from the nozzle. In the present case, as the spray is enclosed within the source housing 62, the only source of gas for entrainment comes from the gas within the chamber, which is provided from the spray itself and as is shown by the looping arrow in FIG. 5*a*. Thus, one has in effect a spray recirculating back into itself. As mentioned above, this has a number of undesirable consequences. It results in a "delay" or "memory" effect when switching from one analyte to another, as it takes some time for the previous analyte to be exhausted from the ion source chamber 100. Recirculation also promotes deposition of analytes on walls of the ion source chamber 100, leading to cross-contamination between samples and aggravating the "delay" effect.

Figure 5B:
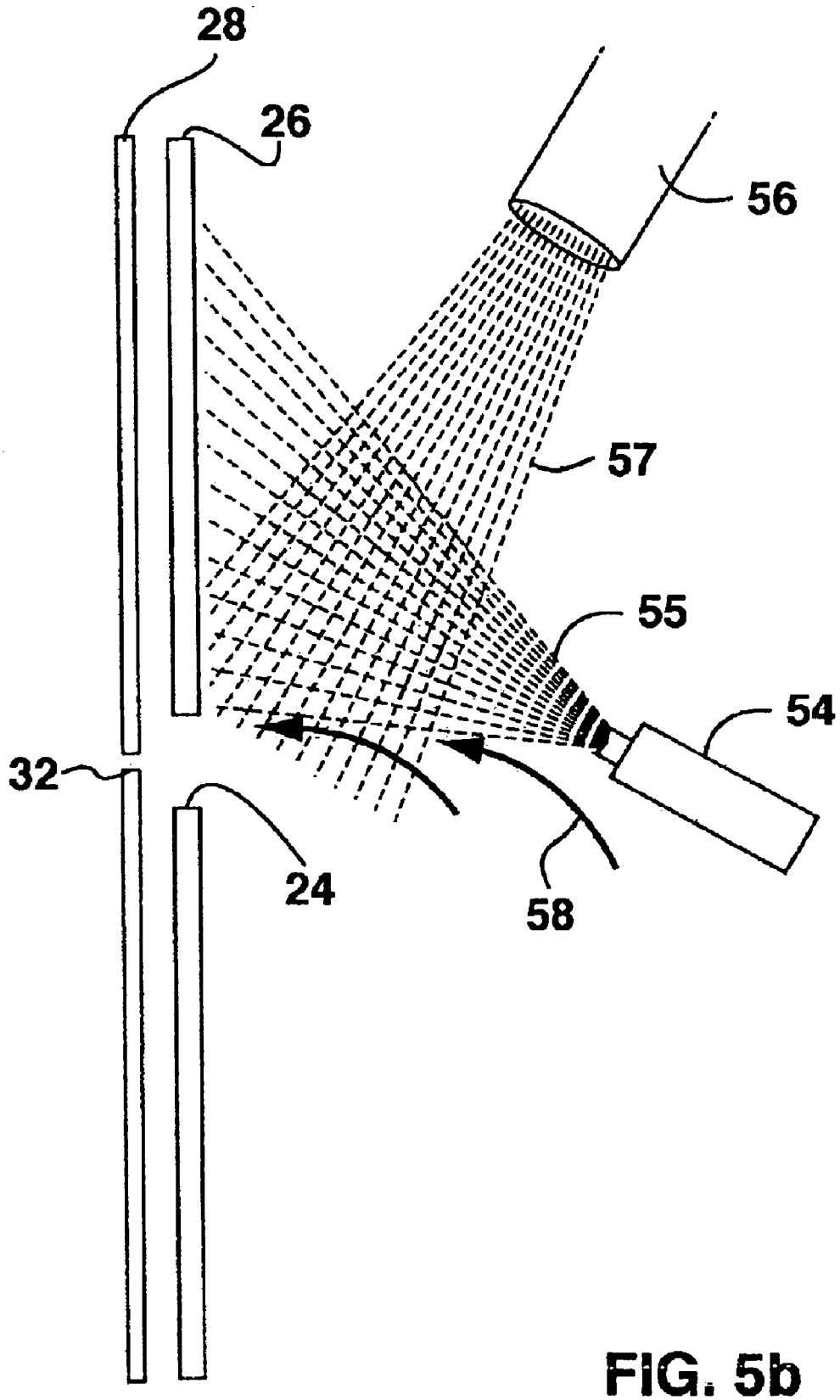
FIG. 5*b* is an schematic diagram showing circulation patterns in the ion source of U.S. Pat. No. 5,412,208.

Referring to FIG. 5*b*, this shows recirculation patterns in an arrangement according to U.S. Pat. No. 5,412,208. Here, a sample source, e.g. a nebulizer, is indicated at 54, generating a spray 55. It is directed to one side of the curtain orifice 24. A gas source 56 produces a gas jet 57 directed to form a mixing region with the spray 58. This configuration is provided in a mass spectrometer produced by the assignee of the present invention. It has been found that the gas source provided insufficient heat and mass transfer efficiency. Heating of the spray is asymmetric, with most of the heating and mixing being on the side away from the orifice 24. As indicated at 58, sampling occurs in an air entrainment rich region, promoting the drawing of unwanted contaminants into the mass spectrometer.

Accordingly, in accordance with the present invention, two specific structural features are provided to reduce the recirculation effect.

The first of these features is the provision of the inner exhaust guide tube 78 extending radially inward to a location adjacent the curtain orifice 24 in close proximity to the ion source, either nebulizer probe 72 or APCI probe 120. As indicated by the arrows 102, in FIG. 6, this extended exhaust arrangement greatly reduces the potential for recirculation, as it enables only a short portion of the spray cone, designated at 106 adjacent the nebulizer source probe 72 to be available for recirculation. It is believed that the critical parameter is the location of the primary exhaust outlet relative to other elements, notably the orifice, the spray cone 106, the ion source probe and gas jets, when present. It is believed that it would be sufficient to raise the bottom of the housing 62, so that no inner exhaust tube is needed and the exhaust outlet can still be at the same location.

Figure 7:
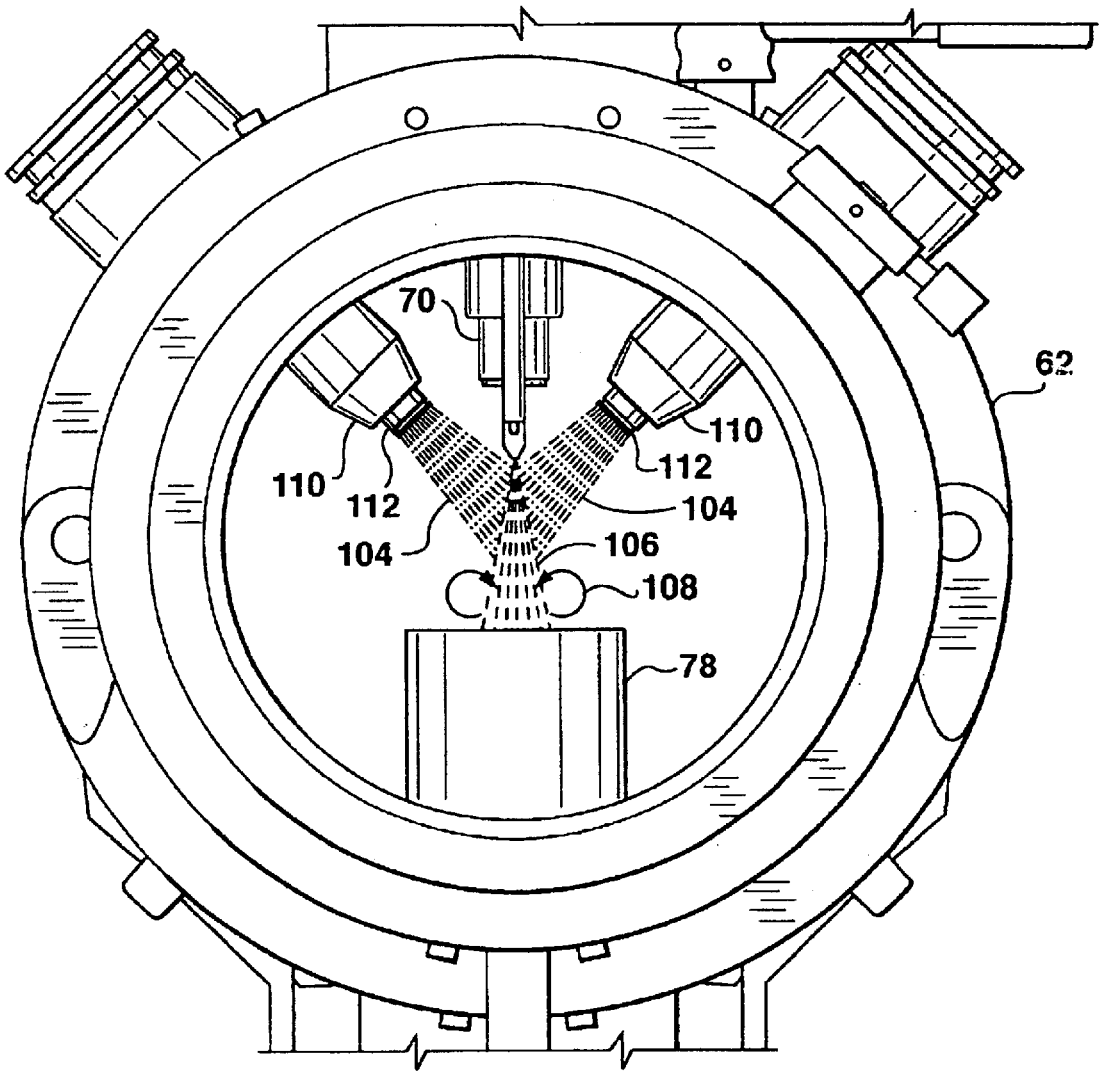
FIG. 7*a* is a view along the axis of the ion source of FIGS. 2 and 3, showing further reduced recirculation.

The source housing 62 is also provided with two gas sources 110, as detailed in FIG. 10. Each gas source 110 is generally tubular, has an inlet 111 and an outlet 112. It includes the heater body 114 formed from ceramic, in a manner detailed below for an APCI source shown in FIGS. 9*a*, 9*b*. This has two layers of ceramic with a thin film resistive heater sandwiched between it to form a ceramic heater tube. In this case, unlike the APCI source, the heat load can be uniform along the length of the gas source 110. Within the heater body 114, there is ceramic heat exchange packing 116, and on the exterior an insulator shell 118 is provided. As shown in FIG. 7, the gas sources or heaters 110 provide gas jets indicated at 104.

FIG. 7 shows the effect of this second structural feature for reducing recirculation, the provision of dual gas jet sources 110. The gas sources 110 are provided in a plane with the ion source probe 72, 120, that is perpendicular to the axis of the source housing 62 and the interface 66. As shown in FIG. 7, the gas sources 110 are arranged symmetrically on either side of a plane containing the ion source probe 72, 120, at an angle of 45 degrees thereto. A preferred range of angles for the gas sources 110 is 15–60°, more preferably 30–50°.

Again referring to FIG. 7, the gas sources 110 produce gas jets 104, that impinge on the expanding spray cone 106 from the ion source 72, 120. The gas jets 104, arranged in this manner, have a number of functions. Firstly, they provide a gas source on either side of the spray cone 106, for gas entrainment. Thus, any gas that the spray cone 106 naturally tends to entrain is then drawn from the gas jets 104, which in any event have a velocity directed towards the spray cone 106. The momentum of the gas jets 104 tends to compress and focus the spray cone 106. The angle of the gas jets 104 promotes turbulent mixing with the spray cone 106, which in turn enhances heating and desolvation of droplets. As indicated by the arrows 108 in FIG. 7, there is then only a small portion of the spray cone 106 immediately upstream from the inner exhaust guide tube 78 available for recirculation which is even smaller than that portion shown in FIG. 6 resulting from the incorporation of the exhaust guide tube 78. Thus, the amount of recirculation is minimized.

A further characteristic of the arrangement of the gas jets 104 is that they do not totally enclose the spray cone 106. Thus, this leaves one side of the spray cone 106 adjacent the curtain orifice 24 open to promote passage of ions into that orifice. However, in another embodiment of the present invention, the gas jets 104, or possibly a single continuous jet, are arranged so that they totally or partially enclose the spray cone 106 in an arc, semi-circle, or complete circle The combination of the above described trajectories of the jet entrainment gas 104 and the ability to heat this to initial gas temperatures of greater than 600 degrees results in a number of advantages that result in higher sensitivity and lower background chemical noise. Firstly, as is detailed below, ceramic heaters are used which provide efficient heat exchange, and enable gas jets to be heated to a temperature of 850° C. The use of two, or possible more, gas streams enables the necessary heat flow to be provided to the spray cone 106, even at high liquid flow rates. Thus, sufficient heat can be provided to ensure desolvation of the droplets. By ensuring that entrained gases are cleaned, hot gases, background noise is reduced. The higher thermal efficiency and thermal load means there is enough desolvation power for higher flow rates.

With this preferred embodiment of the invention the nebulizer source probe 72 operates with a gas flow rate in the range 0.1–10 liters/minute. The amount of entrained air for this type of nebulizer varies along the axial length of the spray. The amount of the recirculation also varies along the axial length of the spray. The degree of entrainment and recirculation increase as distance increases from the tip of the nebulizer source probe 72. Here, the region of the spray cone 106 approximately 10 millimeters downstream from the spray tip was sampled. Based on the theoretical calculations, it is determined that the amount of entrainment is about 10 to 20 times the nebulizer flow rate. This is equivalent to a required total gas flow rate, for the gas jets 104, and in the range of 10–60 liters per minute.

Figure 8:
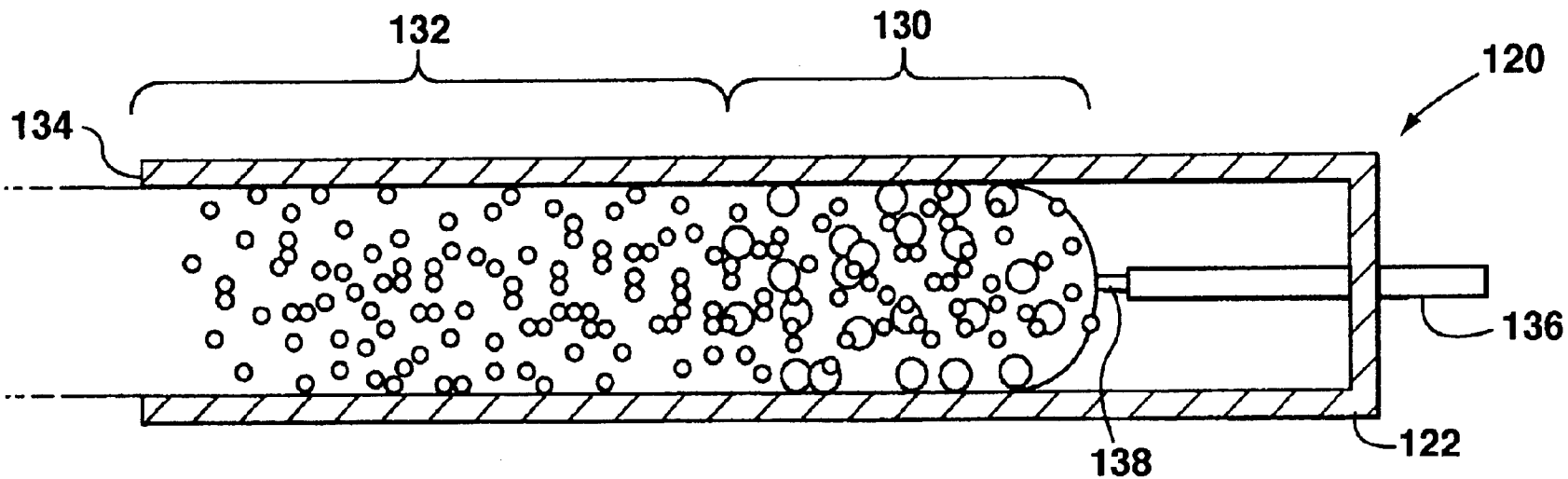
FIG. 8 is a schematic sectional view through atmospheric pressure chemical ionization flash desorption chamber in accordance with a second aspect of the present invention.
Figure 9A:
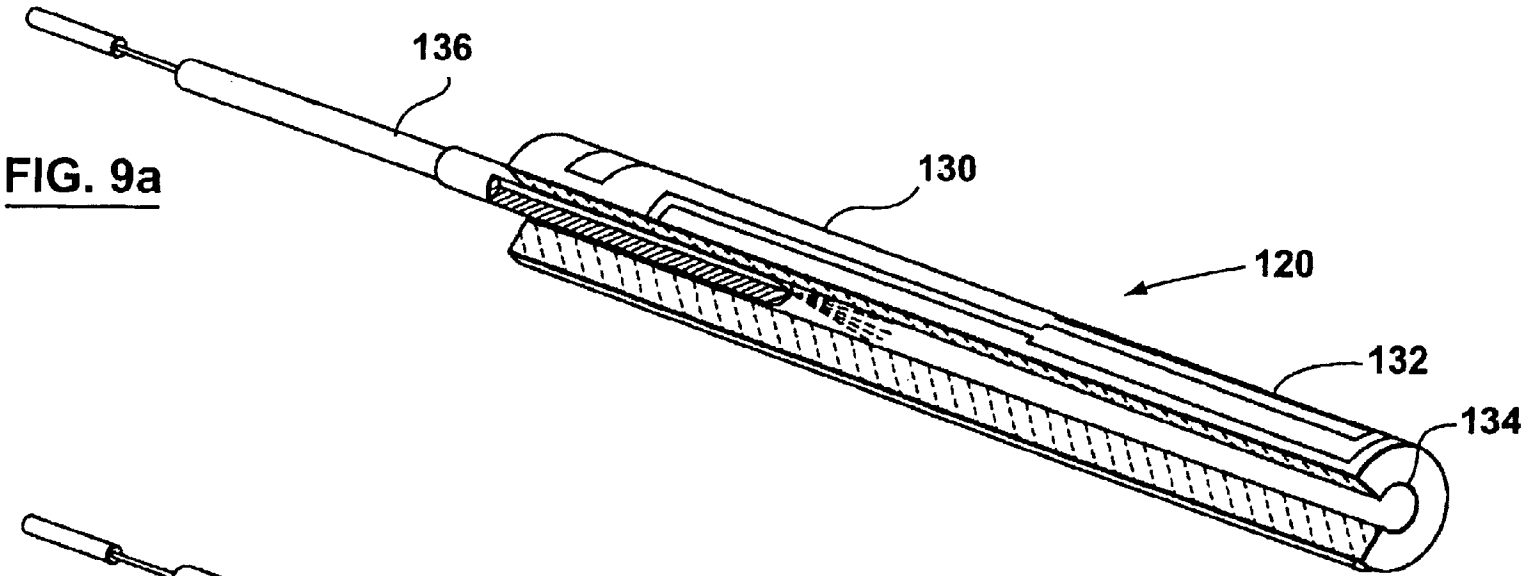
FIGS. 9A and 9B are perspective views showing details of the desorption chamber of FIG. 8.
Figure 9B:
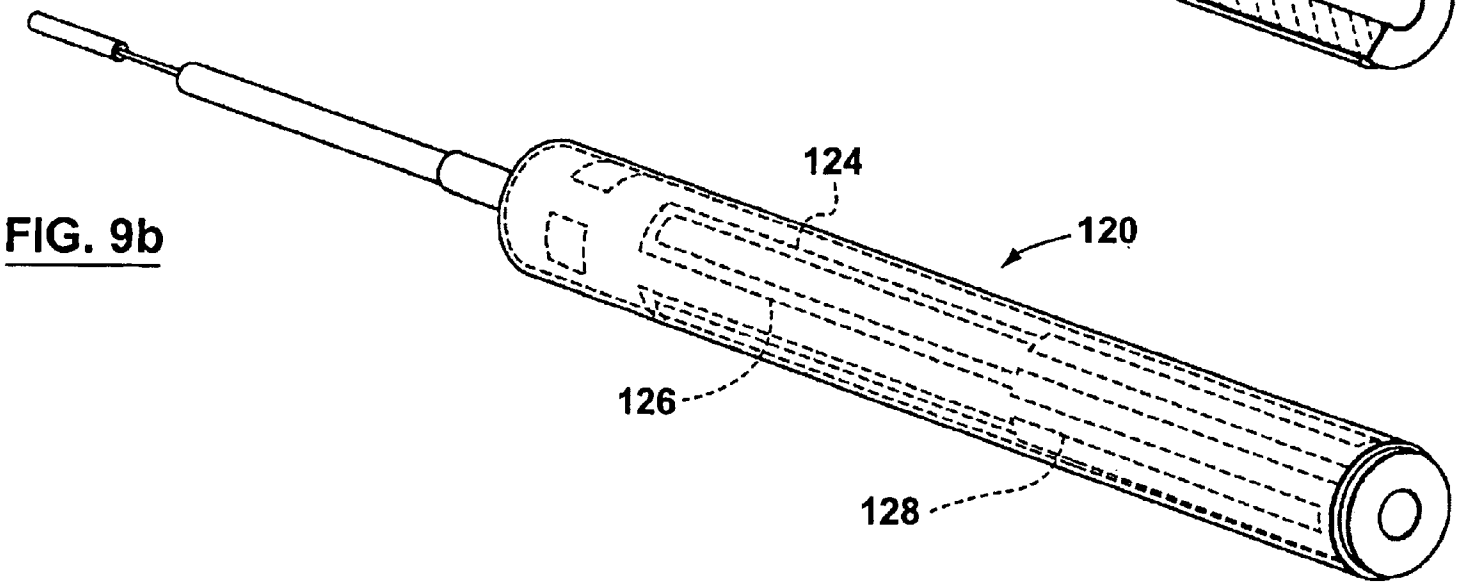

The description above has been in relation to an ion source probe comprising a nebulizer probe 72. As detailed, a significant aspect of the present invention is the provision of the probe holder 70 in the source mounting aperture 68 that readily enables different ion source probes 72, 120 to be inserted. Instead of the nebulizer source probe 72, an atmospheric pressure chemical ionization (APCI) source probe 120 can be used. Reference may now be used to FIGS. 8, 9A and 9B to show a preferred embodiment of an APCI source probe and heater in accordance with the present invention and generally indicated by the reference 120.

Referring to FIGS. 8, 9A and 9B, the APCI source probe 120 is mounted in a tubular body 122 equivalent to heater 71 in earlier figures. The tubular body 122 is made from a sheet of ceramic material that, in an initial state, has a high polymer content, making it very pliable. A thin film heat trace is then painted or printed onto the surface of a second layer of ceramic. This second layer of unfired ceramic is bonded and fused on top of the cylinder formed from the first layer, so that the thin film heat trace is sandwiched between the two layers. The complete tubular shape is then fired, and this forms an embedded ceramic heater 71 or 122 with superior thermal heat transfer As shown, in the complete assembly, the heat trace, indicated at 124 presents a generally sinusoidal profile, with portions traveling from a first end to a second of the tubular shape and then back again. As indicated, the heat trace comprises first portions 126 of relatively narrow cross-section and second portions 128 that are relatively wide, so as to give the first portions a higher relativity resistivity. As the portions 126, 128 are connected in series, this means that more heat will be generated in the first portions than the second portions. The overall effect is to give a primary heating zone 130 that provides a flash zone adjacent an inlet of the probe 120 and a secondary flash zone 132 adjacent an outlet, indicated at 134, for the APCI source probe 120.

As shown, an APCI source probe is provided as a spray tube 136 having an inlet at one end with a connection to a liquid chromatography source or other suitable source of analyte and solvent. One end of the spray tube 136 is located within the tubular body 122 and has a spray tip 138 spaced from the outlet of the tubular body or heater 122. In known manner although not shown, the spray tube 136 has an inlet for a liquid sample and an inlet for a gas to promote desolvation.

The ceramic from which the APCI source probe 120 is formed has a thermal conductivity that is 25 times that of quartz, a material currently used for heaters in equivalent probes produced by the assignee of the present invention. By providing a higher conductivity, there is provided more efficient heat transfer, giving a flash desorption surface. This allows the capability to use much higher liquid flows, before critical cooling occurs. In particular, it is believed that the temperatures achievable with the present invention result in the droplets being heated by the Leidenfrost effect. The Leidenfrost effect occurs when a surface is so hot that a liquid approaching the surface immediately boils to form a vapour film that insulates the bulk of the liquid from the surface. Consequently, there is no direct contact between the liquid and the surface and heat transferred to the liquid must occur through the vapour film. One significant advantage of this effect, in the present context, is that it serves to prevent contamination of the surface with analytes or the materials again greatly reducing or eliminating any tendency to form memory effects.

As noted, the method of forming the source probe 120 is such that a heat trace of any profile can be formed. Here, this is used to form a heat trace providing two different flash zones. The primary flash zone 130 is given a higher heat load, in order to handle a high volume of spray and large droplets present in this zone, to promote vaporization of these droplets, and to ensure that the surface is maintained hot enough to prevent direct contact between the droplets and the surface. While a significant thermal loading is required in the secondary flash zone, by the time the spray reaches the secondary flash zone, many of the droplets have already been vaporized, and any remaining droplets are of reduced size, so that a lower heat loading is required.

The exact mechanism is not fully understood and the following is what the inventors' believe to be a sound theoretical explanation of the desolvation process. The nebulizer produces a distribution of drop sizes with smaller ones concentrating at the radial edge. When the spray is confined in a tube, this is no longer true. Without a gas source to feed the entrainment, the spray quickly develops into a highly turbulent cloud of randomly moving drops of varying sizes. A large part of the spray, consisting mostly of larger drops, will impact the tube surface within 5–10 mm downstream of the nozzle. The temperature of the surface in this region is above the Leidenfrost point for the liquid. As a result, the drops "bounce" off the surface and fragment into smaller drops. These drops may further bounce off the surface further down the tube and fragment into even smaller drops. By the time the cloud reaches half way down the tube, the drop size distribution favors smaller diameters. The temperature of the surface in this region is less than the Leidenfrost point but above the vaporization temperature of the liquid. As the drops are small, they are flash vaporized upon contacting this surface, without significantly wetting or contaminating the surface. If the entire tube was maintained at a temperature above the Leidenfrost point, some of the drops will not vaporize completely, due to the known Leidenfrost effect of a vapor blanket restricting heat transfer to the drops.

The gas heater, shown in FIG. 10, is constructed according to this principle and has exceptionally high watt density capabilities, to generate a very high temperature gas jet. The spray from the nebulizer is thus heated to the required temperature within a short distance, and this means that preheating of gas is not required. The ceramic material has alone a very low adsorption property. As such, the surface is so hot that instant desorption occurs and the surface is always clean, i.e. it is effectively self cleaning.

The thin film technology used to create the heat trace 124 allows for an integrated RTD (Resistive Temperature Detector) sensors to be built directly parallel with the heating element. This enables very accurate temperature feed back and consistency between heaters to be provided. This can be very important when it comes to variations from source to source. In use, users often have many mass spectrometers running the same analysis with the same operating parameters i.e. temperature of the gas. It is important that the same value for the temperature setting will give the same temperature in each of the ion sources on the different machines. Also, if a heater is replaced, the new heater must have the same operating characteristics as the one it replaced. A further advantage of tailoring the heating into different zones is that it enables heat to be kept away from the liquid line components. If the primary flash zone 130 was provided with too much heat, this may be conducted through to the liquid line components, causing unwanted boiling of the liquid prior to the formation of the spray. This enables low flow rates to be achieved without boiling.

Figure 10A:
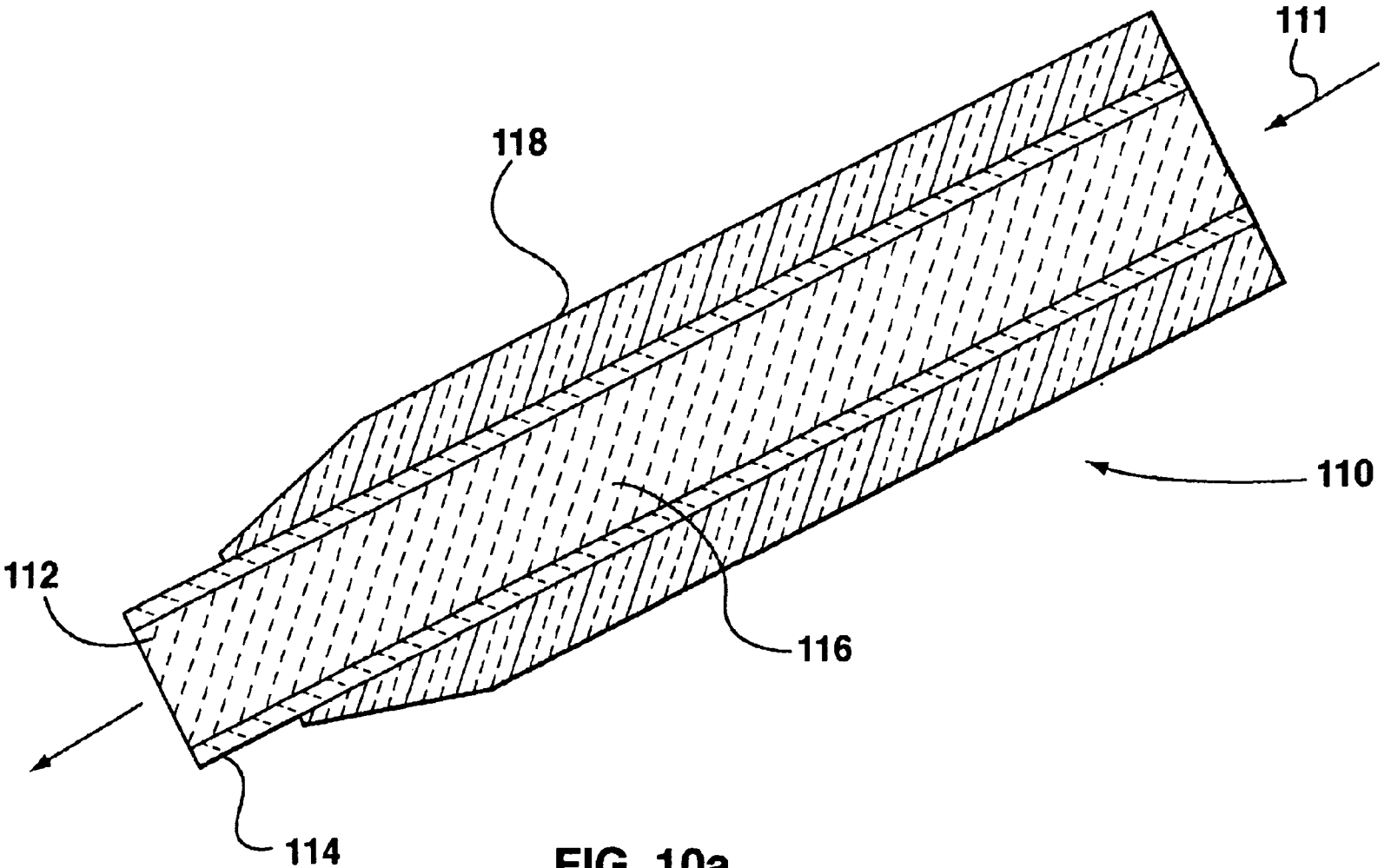
FIG. 10*a* is a sectional view through one embodiment of a gas heater of the ion source.
Figure 10B:
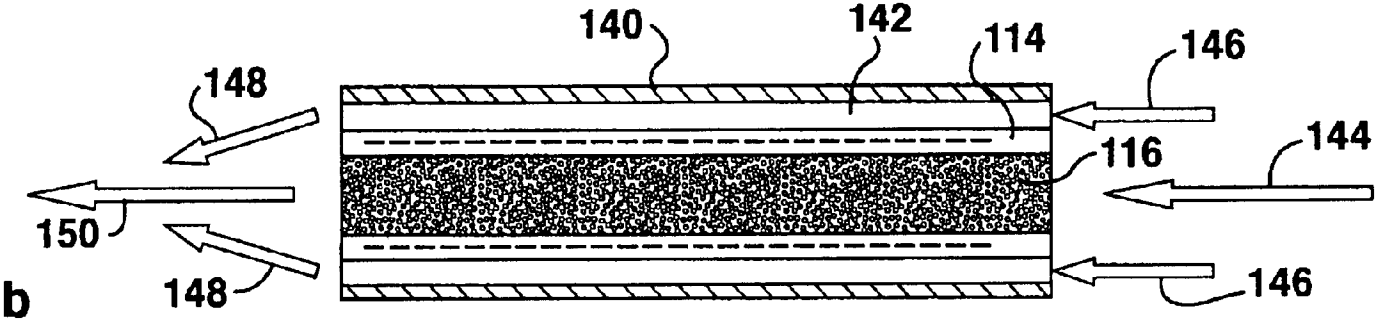
FIGS. 10*b, c*, and *d* are sectional views through other embodiments of the gas heater of the ion sources.
Figure 10C:
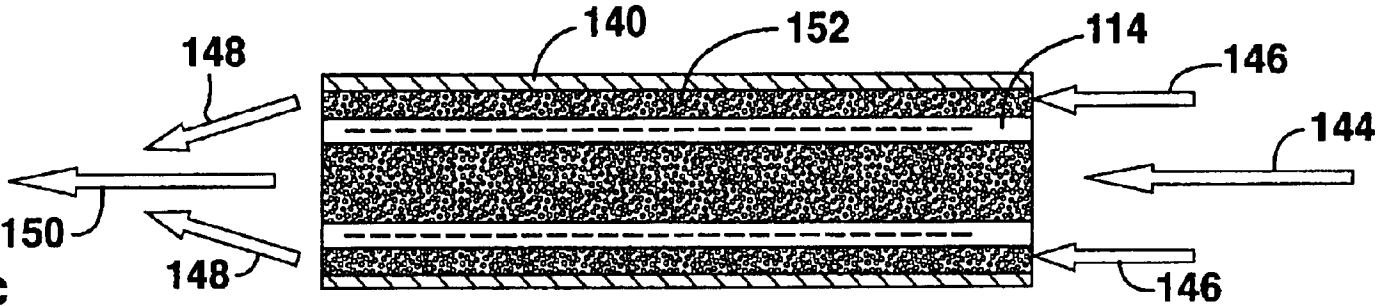
Figure 10D:
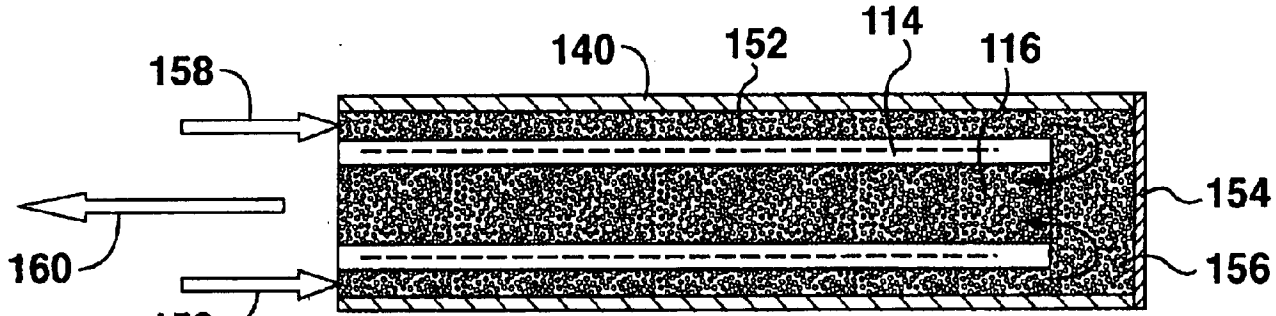

Reference will now be made to FIGS. 10*b*, 10*c* and 10*d*, which show alternative embodiments of the heater feeding the gas. For simplicity, the heater body 114 formed from ceramic and the heat exchange packing 116 are denoted by the same reference numerals. What is different in these three additional embodiments of the heater is the provision of an annular space between the heater body 114 and the insulated shell, now denoted by the reference 140.

Thus, in FIG. 10*b*, there is an annular space 142 between the insulator shell 118 and the heater body 114. As indicated, gas flowing into the heater flows either through the heat exchange packing 116 (arrow 144) or through the annular space 142 (arrows 146). At the exit, arrows 148, 150 indicate that the gas flows are combined.

In the embodiment of FIG. 10*c*, the annular space is filled with additional ceramic beads to enhance heat transfer, as indicated at 152. Gas flows are again indicated by the same reference numerals 144–150.

FIG. 10*d* indicates a possible further variant. Here, the insulated shell 140 extends beyond the heater body 114 and is closed off as indicated at 154. An end space is then filled with additional beads indicated at 156. Again, the exterior annular space between the heater body 114 and the insulator shell 118 is filled with ceramic beads 152. Here, gas would be supplied as indicated by the arrows 158, to travel in a first direction towards the end of the insulator shell 140. The gas direction then reverses and it flows through the central ceramic heat exchange packing 116 and exits as indicated by the arrow 160.

The heaters are manufactured by laminating metallized ceramic sheets together and then sintering them to create a solid piece and forming them into a tube configuration; typically, this is with a 2–3 mm internal diameter, a 4–6 mm outside diameter and a length of 5–25 cm. The metallization is for the purpose of resistive heating. Gas flowing through the tube is heated by both convection and radiation. To improve the heat transfer efficiency, the center of the tube is packed with small ceramic beads (0.5–1.0 mm diameter). The beads promote conductive heat transfer to the beads and provide a larger surface area for convective heat transfer. Thus, the ceramic heater tube heats the beads and in turn they transfer heat to the gas with the beads providing a greater surface area.

In the embodiments of FIGS. 10*b*–10*d*, a second gas flow is provided, passing over the exterior of the heater tube, to capture heat that would otherwise radiate outwards. The two gas flows are merged and mixed at the exit of the heater tube, in FIGS. 10*b* and 10*c*. The total gas flow rate would be the same as for the embodiment of FIG. 10*a*.

Ceramic beads are used because of their high operating temperature, small uniform size and high thermal conductance. There are other materials of high thermal conductance, but to applicants' knowledge, many alternative materials do not operate well at elevated temperatures. Ceramic is also chemically inert, which is desirable for this application, to minimize accidental introduction of background noise.

All these features together enable enhancements, as described in relation to FIG. 12, of six to ten times those achievable with known designs. A further advantage of the configuration shown is that it is believed that the spray extends to the wall or reaches the wall within millimeters of the spray tip 138. For example, in observations in free space, i.e. with the spray totally unconfined, the total angle spray cone is in the region 25–30 degrees. Here, the diameter of the tubular body 122 is four millimeters, and has a length of 120 mm. Thus, within seven millimeters of the spray tip 138, the diameter of the spray cone is four millimeters, and this is in free space. Consequently, in the tubular body 122, in less than seven millimeters downstream from the spray tip 138, droplets should contact the hot, interior surface of the tubular body 122.

Note that the spray is in a confined zone, there is no source to supply gas for entrainment or recirculation, for turbulent mixing. Consequently, the spray is expected to be forced to adopt a larger spray angle than it does in free space. In free space, the spray cone readily entrains gas, causing the cone to expand more rapidly, i.e. with a larger angle.

As noted above the present invention enables switching between a nebuliser and an APCI source to achieved quickly and simply. It is also too noted that the detailed implementation of the two ion sources are different as compared to commercial embodiment of the ion source described in U.S. Pat. No. 5,412,208 and marketed by the assignee of the present invention as a component of its API 3000 mass spectrometry instrument.

In that prior commercial embodiment, the APCI probe has provision for a regular nebulliser gas at a flow rate of 2–3 liters/min, giving a velocity of the order of 450 m/sec. Sample flow rate is in a range up to 1 ml/min. Additionally, an auxiliary gas is provided through an outer annular channel at a flow rate of 2–3 liters/min and a gas velocity of the order of 3 m/sec. The auxiliary gas is provided to give sufficient gas volume, and is believed to provide sufficient volume for desolvation and/or giving adequate momentum to the flow. These flows all discharge into a heated desolvation tube maintained at a temperature of 500 deg. C. max., and typically nearer 450 deg. C.

The nebuliser source in this commercial embodiment was similar, but with no auxiliary gas and no heated tube. The flow rates are otherwise similar. In particular, for both ion sources, the tube for the nebuliser gas has an inside diameter of 0.3 mm, and they both have the same size capillary tube for the sample flow, with an inside diameter of 100 microns and an outside diameter of 0.3 mm.

The single gas jet provided has dimensions to give velocities in the range 0.25–10 m/sec. for a flow rate in the range 0.25–10 liters/min.

In the ion source of the present invention, a number of changes are made. Firstly, the same size capillary is used for both the nebuliser and the APCI. For the APCI source, no auxiliary gas is required, as is apparent from the description above. The arrangement with two gas jets heated to a higher temperature has been found to provide adequate heat and gas volume. In fact it has been found that provision of an auxiliary gas actually reduces the performance. The concept here is to create a turbulent cloud adjacent the orifice and an additional gas flow, coaxial with the sample flow appears to add too much momentum in one direction, so as to displace this cloud and to dilute the ions present. This also makes it easier to design APCI and nebuliser source probes that can be readily interchanged in the heater 71.

The regular nebuliser probe of the invention is different in one significant aspect. The tube for the nebuliser gas flow has an internal diameter of 0.38 mm. so as to reduce the effective cross-section by 20%, which in turn means that, for a given gas flow rate, the velocity is increased by 20%.

In the earlier commercial embodiment, there was a single gas jet, giving flow rates in the range 1–10 l/min. With the present invention, two gas jets are provided, with individual flow fates up to 6 l/min. for a total flow rate from the two jets of 12 l/min. The gas can be nitrogen or zero air. Note also, that, in the present invention, as the air is heated to a temperature of up to 850 deg. C., this will cause the gas to expand considerably, thereby increasing its velocity.

In FIGS. 11 and 13, the sample was supplied through a nebulizer. In FIG. 12, the sample was supplied through an APCI source, e,g, as 9 for the results in FIG. 12*a*.

Figure 11A:
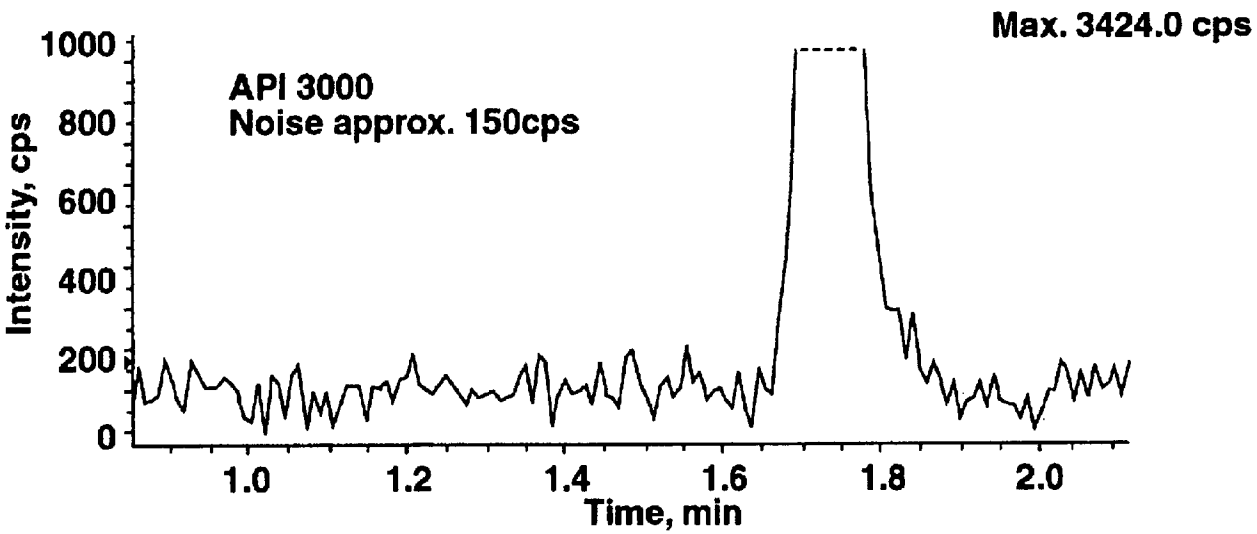
FIGS. 11*a* and 11*b* are graphs showing background noise comparisons between the present invention and a prior art ion source in accordance with U.S. Pat. No. 5,412,208.
Figure 11B:
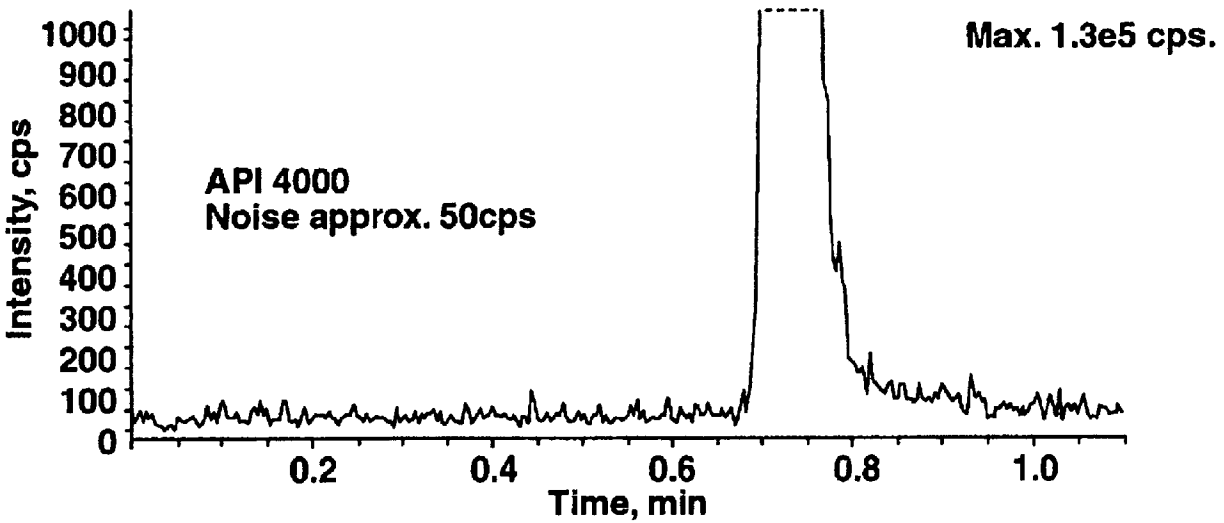
Figure 12A:
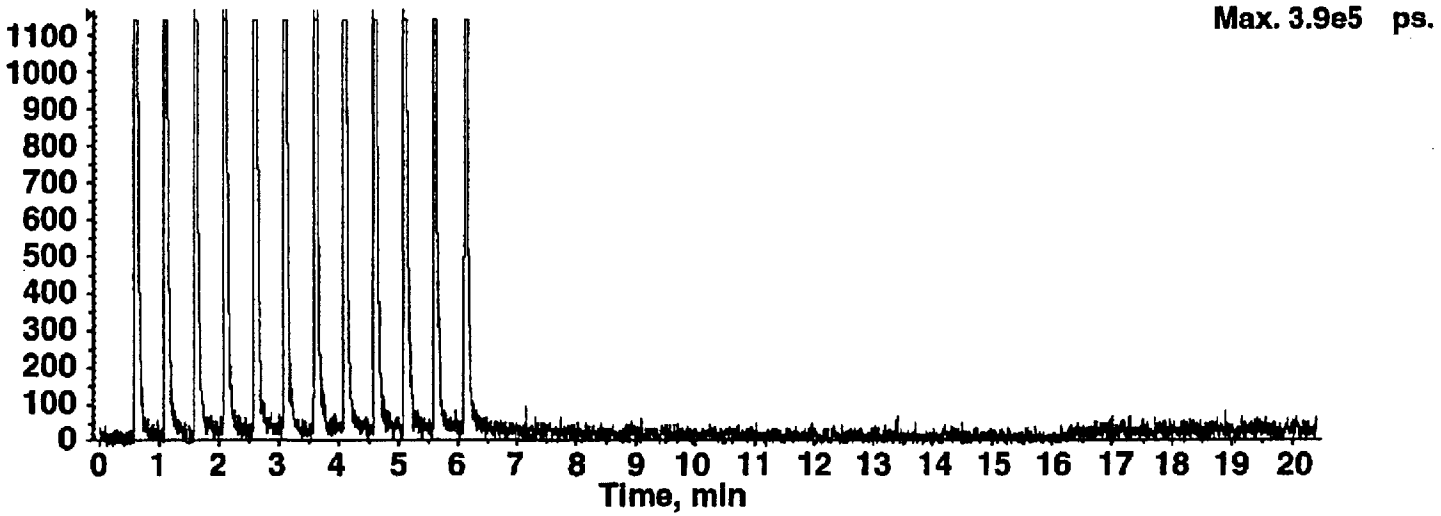
FIGS. 12*a* and 12*b* show comparison of background noise and memory effects between the ion source of U.S. Pat. No. 5,412,208 and the present invention.

Referring now to FIGS. 11*a* and 11*b*, these graphs show a comparison of the background noise level and absolute signal intensity achievable with the prior art ion source configured in accordance with U.S. Pat. No. 5,412,208 and the ion source of the present invention. In both cases, the same amount of the same sample compound was injected into a 1000 μL/min continuous flow of eluent and the signal intensities are expressed in counts per second (CPS). The background chemical noise levels are observed as the continuous baseline trace in the graphs. When the sample compound enters the ion source in the flowing eluent a peak is observed, its intensity measured in CPS and this intensity measurement is synonymous with sensitivity. Both of the traces show the peak off scale to accentuate the baseline but the maximum peak height observed is recorded in the upper right hand corners. Ideally the baseline is zero but it rarely achieves that value. The signal to noise ratio (s/n), the most meaningful measurement upon which to base performance, qualified as limit-of-detection (LOD), is the ratio of this peak height signal (sample) divided by the baseline or noise signal (background).

FIG. 11*a* shows the performance of an older source, generally in accordance with U.s. Pat. No. 5,412,208, operating at its maximum temperature of 550 degrees C. This shows a background of 150 cps. The performance of the source of the present invention is shown in 11*b* and this shows a background reduction of 3× (50 cps), operating at gas temperature of 800 degrees C. It is to be noted that the peak in both chromatograms is off scale (both figures are normalized to 1000 cps so the baseline was clear). The absolute peak heights are indicated in the upper right corner of each figure, 3424 cps for ha and 130,000 cps 11*b*. Thus, the ion source of the present invention has improved the signal by 35× (as a result of the improved vaporization efficiencies also an effect of the entrainment mixing and the reduced dispersion of the spray from the compression effect of the two gas jets) and at the same time reduced the absolute background by 3×. This means in essence that, with the entrainment gas configuration the invention reduced the background noise by 3×38=114×. In this case we see a detection limit improvement of about 114. If there was no improvement in the background reduction then, with this amount of absolute signal increase (38×) one would expect to see the background signal to rise to 150 cps×38=5700 cps. But instead, the background was 50 cps, i.e. 114 times lower than expected. So, there was achieved a signal to noise ratio (s/n) of 130,000 cps/50 cps=2600. If there was no improvement in background reduction we would have expected to see a s/n of 130,000 cps/5700 cps=23×; i.e. comparable to the figures from the earlier ion source of s/n ratio of 3424/150=23×.

These improvements are attributable to the combined effect of the initial gas temperatures in excess of 600 degrees C. and the described trajectories of these gas jets optimized to feed the entrainment region of the spray cone 106, induce rapid mixing, thermal energy transfer, and ultimate droplet evaporation. This effect, in addition to the reduction of the dispersion of the spray by the jets in this configuration results in a sensitivity increase over prior methods, most notable with the higher liquid loads. The suppression of the recirculation effects induced by the described gas jet trajectories is responsible for the chemical noise reduction which leads to the signal to noise improvements observed.

Figure 12B:
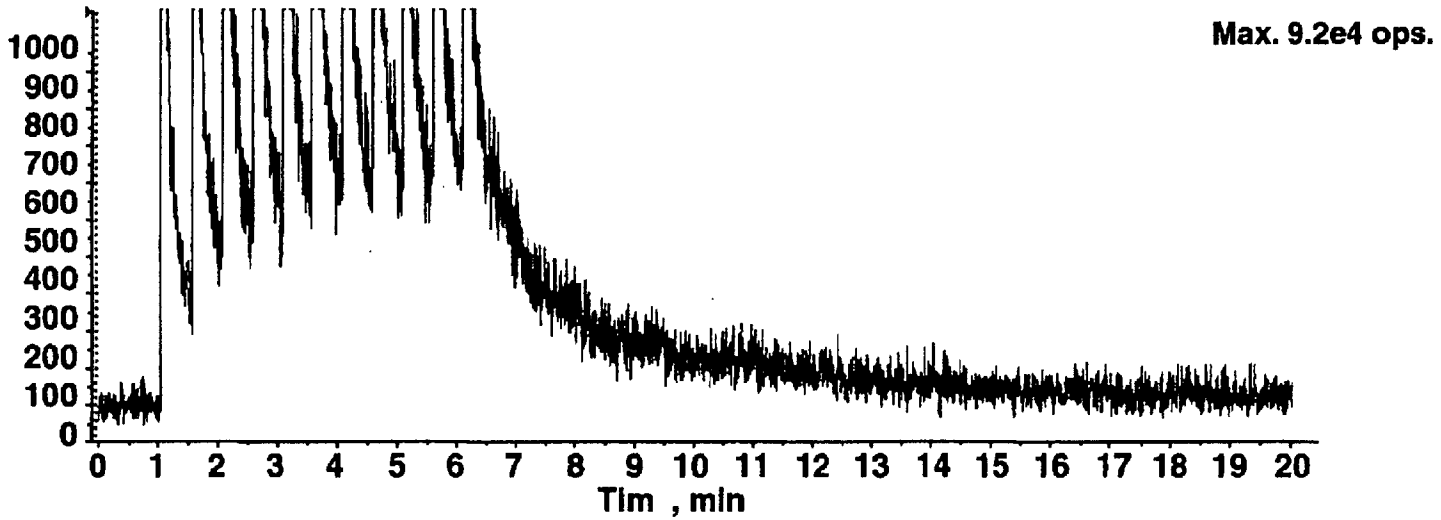

Referring now to FIGS. 12*a* and 12*b*, these graphs show a comparison of background noise/memory effects between the ion source of U.S. Pat. No. 5,412,208 and the ion source of the present invention. For both tests, the same sample volume was injected into a 1,000 μL/min. continuous flow of eluent (or effluent) every 30 seconds, but note that the sample concentration in FIG. 12*a* was greater, giving 500 pg with each injection as compared to 25 pg in FIG. 12*b*. It can be seen in FIG. 12*b*, the time for the signal to return to the base line was much greater, and indeed greater than the 30 second period. It can be seen that over a period of minutes, while the samples were being injected, the base line signal was, effectively, continuously rising, and after injection of the samples was terminated, it took a matter of minutes for the signal to return to the original base line level.

In contrast, in FIG. 12*a*, with the source of the present invention, the signal returned sharply to the base line in every case, in a period much less than 30 seconds.

Note that in FIG. 12*b*, it would take approximately four minutes before the base level was reached, whereas in FIG. 12*a*, with the present invention, original base line is recovered within a matter of seconds. This improved recovery and reduction memory effect is due to a number of effects, namely, providing the inner exhaust guide tube 78, to reduce recirculation back into the spray and to reduce deposition on surfaces within the housing 62 due to recirculation; provision of additional gas jets to focus the spray and reduce recirculation; and greater Leidenfrost effects resulting from the provision of heaters capable of heating the gas jet to a higher temperature.

Figure 13A:
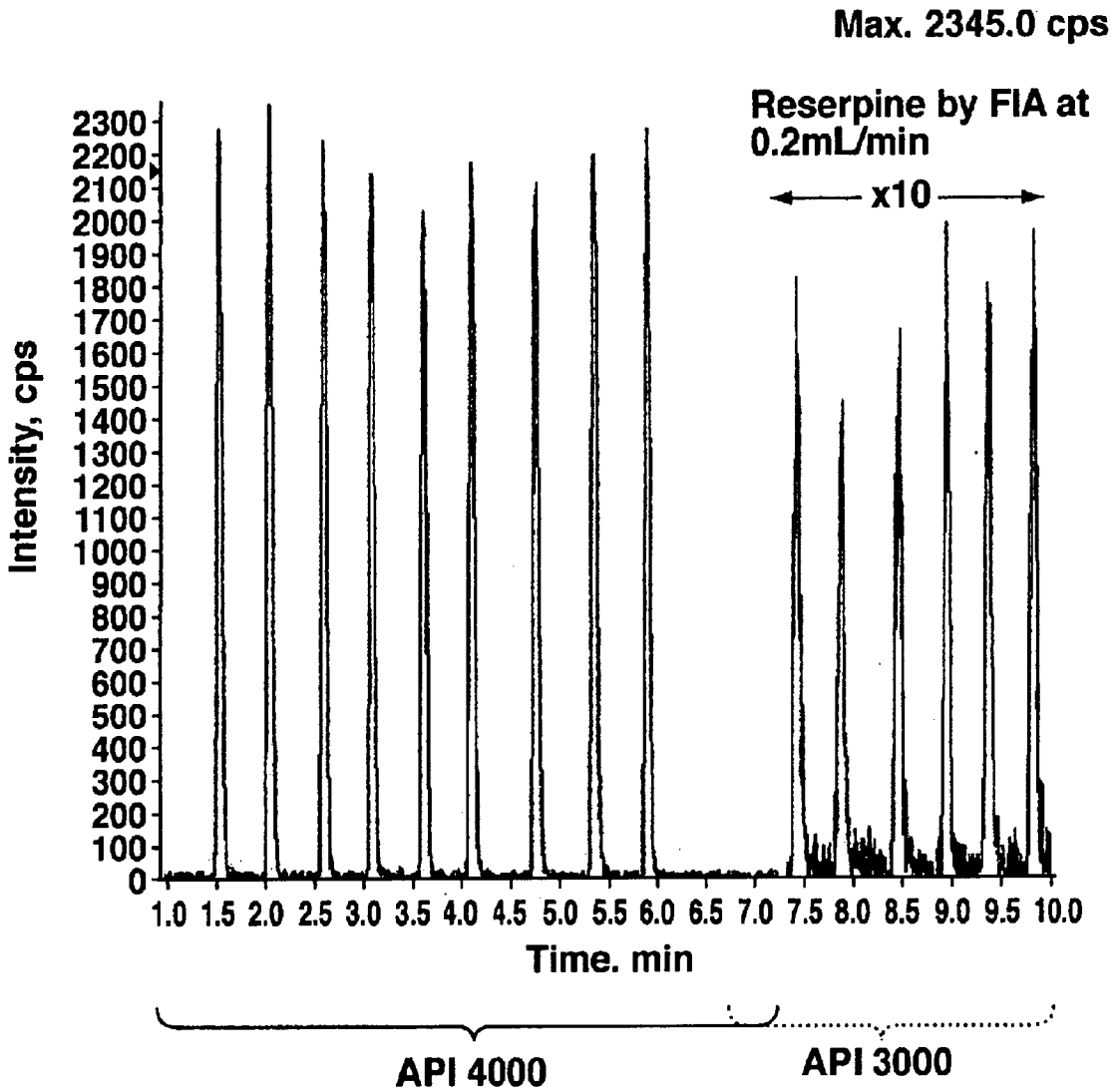
FIGS. 13*a* and 13*b* show the effect of different flow rates between the ion source of the present invention in the ion source of U.S. Pat. No. 5,412,208.
Figure 13B:
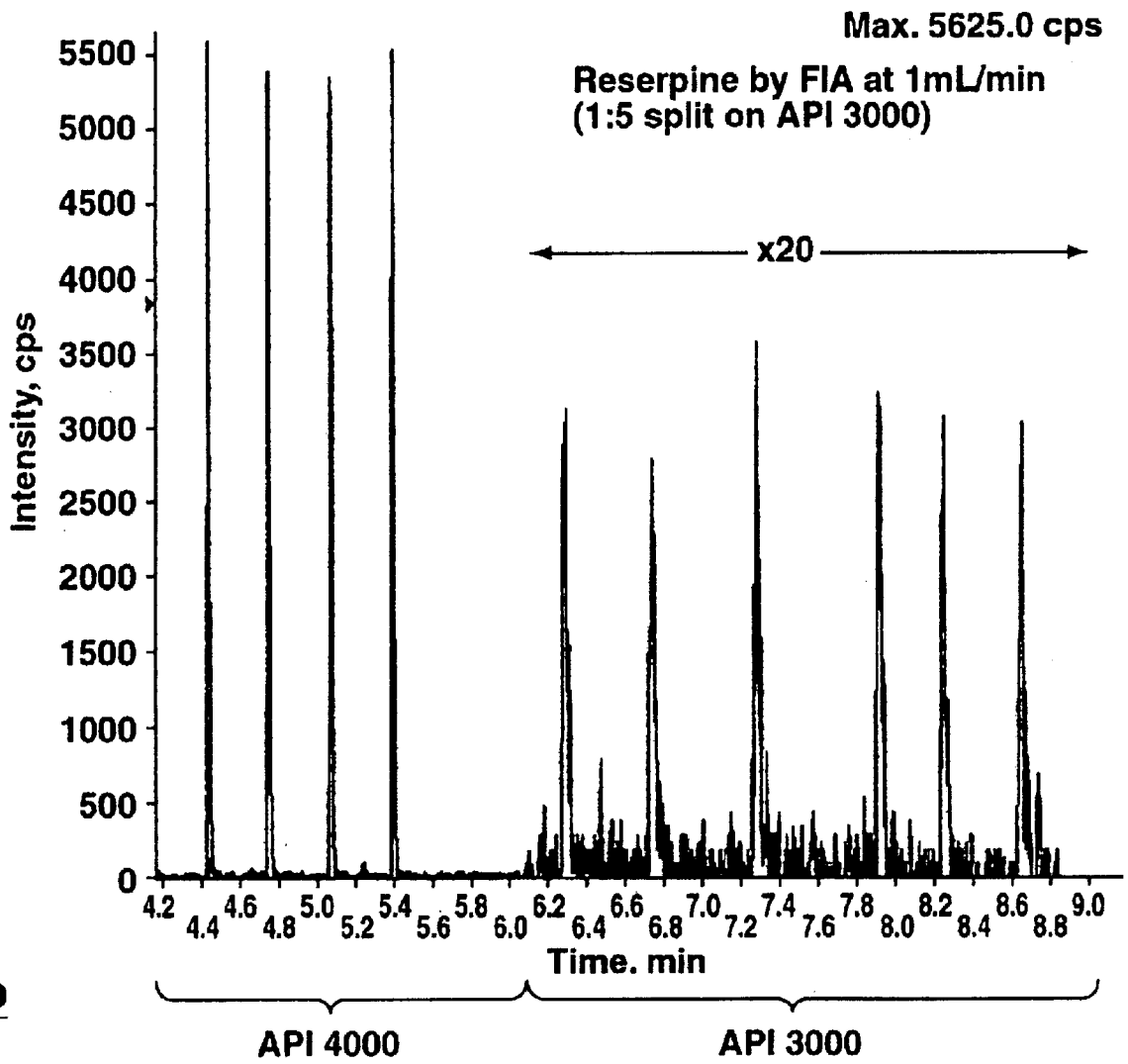

Referring now to FIGS. 13*a* and 13*b*, these graphs compare the absolute ion intensity between an ion source as in U.S. Pat. No. 5,412,208 and an ion source in accordance with the present invention. For both these figures, the sample chosen was reserpine.

In FIG. 13*b*, the flow rates were 1 millimeter per minute for both the older ion source of U.S. Pat. No. 5,412,208, and the ion source of the present invention.

These figures show the data from the prior art ion source had to be multiplied by a factor of ten in FIG. 13*a* and factor of greater than 20 in FIG. 13*b* in order to render them comparable with data from the ion source of the present invention. This shows the greatly enhanced sensitivity and the greater improvements to be obtained at the higher flow rates that can be used with the ion source of the present invention.

The ion source of the present invention has improved sensitivity across the entire flow regime, essentially from 1 $\mu$L/min to greater than 2000 $\mu$L/min. With the older and conventional ion sources, drop off in signal as the flow rate was increased. The source of the present invention has ameliorated this problem so that there is virtually no drop off in sensitivity as the flow is increased. Although the improvements are present at all flows, the degree of improvement is much greater at the higher flow. For instance, comparing the present invention to one as in U.S. Pat. No. 5,412,208, we have seen an improvement of 2× at 1 $\mu$L/min but an improvement of 20× in sensitivity at 1000 $\mu$L/min.

One could also note the greatly enhanced signal to noise ratio present with the ion source of the present invention, with factors greater than 100× observed as shown in the comparisons of FIGS. 11*a* and 11*b*.

While the preferred embodiments of the present invention have been described, it is to be understood that various changes and modifications are encompassed by the present invention, as defined in the following claims. For example, while the description above provides individual gas jets, it is possible that the gas jets could be merged to provide some form of continuous jet providing the same function. More particularly, it is envisioned that the gas jet, in its cross-section, could have a shape of a semi-circle, part of an arc of a circle or a complete circle, extending around the spray cone from the nebulizer, on a side opposite the orifice.

What is claimed is:

1. A method of forming ions for analysis from a liquid sample comprising an analyte in a solvent liquid, the method comprising:

a) providing a capillary tube having a free end, and an orifice member spaced from the free-end of the capillary tube and having an orifice therein;

b) directing the liquid through the capillary tube and out the free-end, to form a first flow comprising a spray of droplets of the liquid sample, to promote vaporization of the solvent liquid;

c) generating an electric field between the free-end of the capillary and the orifice member, and thereby causing the droplets to be charged, and directing the first flow in a first direction along the axis of the capillary tube;

d) providing second and third flows of a gas, and heating the second and third flows;

e) directing the second and third flows in respective second and third directions to intersect with the first flow at a selected mixing region, to promote turbulent mixing of the first, second and third flows, the first, second and third directions being different from one another, and each of the second and third directions being selected to provide each of the second and third flows with a velocity component in the first direction and a velocity component towards the axis of the capillary tube, thereby to promote entrainment of the heated gas in the spray, with the heated gas acting to assist the evaporation of the droplets to release ions therefrom; and f) drawing at least some of the ions produced from the droplets through the orifice for analysis.

2. A method as claimed in claim 1 which includes providing said selected region spaced from the free end, and directing said first flow away from the orifice.

3. A method as claimed in claim 2, which includes providing said first direction perpendicular to the axis of the orifice.

4. A method as claimed in claim 1, 2 or 3, wherein the first, second and third directions lie in a common plane.

5. A method as claimed in claim 3, which includes providing the first, second and third directions in a common plane perpendicular to the axis of the orifice.

6. A method as claimed in claim 5, which includes providing the second and third directions symmetrically on either side of a plane including, the axis of the capillary tube and the orifice.

7. A method as claimed in claim 6, which includes providing the second and third directions at an angle of approximately 45 degrees to the first direction.

8. A method as claimed in claim 2, which includes providing at least one additional flow of the gas, heating each of the additional gas flows, and directing each of the additional gas flows toward the selected region at an angle to the first direction, and providing each of the additional gas flows with a velocity component in the first direction and a velocity component toward the axis of the capillary tube.

9. A method of forming ions for analysis from a liquid sample comprising an analyte in a solvent liquid, the method comprising:

a) providing a capillary tube having a free end, and an orifice member spaced from the free-end of the capillary tube and having an orifice therein;

b) directing the liquid through the capillary tube and out the free-end, to form a first flow comprising a spray of droplets of the liquid sample, to promote vaporization of the solvent liquid;

c) generating an electric field between the free-end of the capillary and the orifice member, and thereby causing the droplets to be charged, and directing the first flow in a first direction along the axis of the capillary tube;

d) providing a continuous arc jet, of a gas, extending in an arc at least partially around the axis of the capillary tube and heating the arc jet of gas;

e) directing the arc jet of gas to intersect with the first flow at a selected mixing region, to promote turbulent mixing of the first flow and the arc jet of gas, all of the arc jet of gas being directed at an angle to the first direction, said angle being selected to provide all of the arc jet of gas with a velocity component in the first direction and a velocity component towards the axis of the capillary tube, thereby to promote entrainment of the heated gas in the spray, with the heated gas acting to assist the evaporation of the droplets to release ions therefrom; and f) drawing at least some of the ions produced from the droplets through the orifice for analysis.

10. A method as claimed in claim 1, 2, 5 or 9, which includes providing an exhaust outlet adjacent the selected region and the orifice, and withdrawing spent gas, vaporized liquid and any remaining droplets downstream from the orifice, to reduce unwanted recirculation.

11. A method as claimed in claim 10, which includes providing an outer exhaust tube, connecting the outer exhaust tube to a source of low pressure to draw gas, vaporized liquid and any remaining droplets from the ion source housing and providing an opening between the outer exhaust tube and the exhaust outlet, open to atmosphere, thereby to maintain a pressure not substantially different from atmospheric pressure within the ion source housing.

12. An apparatus for generating ions for analysis from a sample liquid containing an analyte, the apparatus comprising:

a) an ion source housing defining an ion source chamber;

b) a capillary tube, for receiving the liquid and having a first free end in the chamber for discharging the liquid into the chamber as a first flow comprising a spray of droplets in a first direction;

c) an orifice member in the housing and having an orifice therein providing communications between the ion source chamber and the exterior thereof, the orifice being spaced from the free end of the capillary tube;

d) connections for the capillary tube and the orifice member, for connection to a power source, to generate an electric field between the free end of the capillary tube and the orifice member; and e) two gas sources, each gas source comprising a heater for the gas and a gas outlet, for generating second and third flows of the gas, wherein the second and third flows are directed in respective second and third directions to intersect with the first flow at a selected mixing region for turbulent mixing of the first, second and third flows, the first, second and third directions being different from one another, and each of the second and third directions providing the second and third flows with a velocity component in the first direction and a velocity component towards the axis of the capillary tube, whereby in use, the spray formed from the first flow turbulently mixes with heated gas of the second and third flows in the selected region, to promote evaporation of droplets of the liquid in the first flow to release ions therefrom and whereby the ions pass through the orifice for analysis.

13. An apparatus as claimed in claim 12, wherein the selected region is spaced from the free end of the capillary and from the orifice.

14. An apparatus as claimed in claim 13, wherein the first direction is perpendicular to the axis of the orifice.

15. An apparatus as claimed in claim 12 or 13 wherein the first, second and third directions lie in a common plane.

16. An apparatus as claimed in claim 14, wherein the first, second and third directions lie in a common plane perpendicular to the axis of the orifice.

17. An apparatus as claimed in claim 16, wherein the second and third directions are located symmetrically on either side of a plane containing the axis of the capillary tube and the orifice.

18. An apparatus as claimed in claim 17, wherein the second and third directions are inclined at an angle of approximately 45 degrees to the first direction.

19. An apparatus as claimed in claim 13, which includes at least one additional gas source.

20. An apparatus as claimed in claim 12, wherein the heater of each of the gas sources comprises a ceramic heater tube including an embedded heater element and heat transfer packaging within the heat tube.

21. An apparatus as claimed in claim 20, wherein the heat transfer packaging comprises ceramic beads.

22. An apparatus as claimed in claim 21, which includes, for each heater, an insulator shell around the ceramic heater tube and spaced therefrom, to form an annular channel for additional gas flows.

23. An apparatus as claimed in claim 22, wherein the annular channel of each heater is filled with ceramic beads to provide additional heat transfer.

24. An apparatus as claimed in claim 23, wherein, for each of the heaters, one end of the insulator shell is closed, an inlet and an outlet for gas are provided at one end of the heater with the inlet opening into the annular channel and with one end of the ceramic heater tube providing the gas outlet.

25. An apparatus for generating ions for analysis from a sample liquid containing an analyte, the apparatus comprising:

a) an ion source housing defining an ion source chamber;

b) a capillary tube, for receiving the liquid and having a first free end in the chamber for discharging the liquid into the chamber as a first flow comprising a spray of droplets in a first direction;

c) an orifice member in the housing and having an orifice therein providing communications between the ion source chamber and the exterior thereof, the orifice being spaced from the free end of the capillary tube;

d) connections for the capillary tube and the orifice member, for connection to a power source, to generate an electric field between the free end of the capillary tube and the orifice; and e) a gas source, comprising a heater for the gas and an arc-shaped gas outlet, for generating an arc jet of the gas, wherein the arc jet is directed at an angle to the first direction, to intersect with the first flow at a selected mixing region for turbulent mixing of the first flow and the arc jet of gas, the angle being such as to provide all of the gas of said arc jet with a velocity component in the first direction and a velocity component towards the axis of the capillary tube, whereby in use, the spray formed from the first flow turbulently mixes with heated gas of the arc jet in the selected region, to promote evaporation of droplets of the liquid in the first flow to release ions therefrom and whereby the ions pass through the orifice for analysis.

26. An apparatus as claimed in claim 25, which includes an exhaust opening in the ion source housing, located downstream from the selected mixing region, for withdrawing spent gas and liquid, to reduce recirculation within the ion source housing.

27. An apparatus claimed in claim 26 which includes an outer exhaust tube, a pump connected to the outer exhaust tube for maintaining a sub-atmospheric pressure and an opening between the exhaust opening and the outer exhaust tube, whereby gas and vapour flows from the exhaust outlet and from the opening, through the outer exhaust tube to the pump, balance one another, to maintain a substantially atmospheric pressure within the ion source housing.

28. An apparatus for generating ions from a liquid sample comprising a solvent liquid and an analyte dissolved therein, the apparatus comprising:

a) an ion source housing defining an ion source chamber;

b) at least one ion source within the ion source housing for generating a spray of droplets of the liquid sample;

c) an orifice member in the ion source housing having an orifice therein and being spaced from the ion source;

d) connections for connecting the orifice member and the ion source to a power supply for generating an electric field therebetween;

e) at least one gas source having a heater and a gas outlet, each gas source being mounted in the ion source housing and being directed in a direction towards a selected mixing region, to promote turbulent mixing of the spray and the gas; and f) a primary exhaust outlet in the ion source housing located adjacent and downstream from the selected region, to reduce recirculation of spent gas and liquid sample within the ion source housing.

29. An apparatus as claimed in claim 28, which includes a secondary exhaust outlet in the ion source housing, and an internal exhaust guide tube within the housing extending between the primary exhaust outlet and the secondary exhaust outlet.

30. An apparatus as claimed in claim 29, wherein the orifice member has a conical profile, the internal exhaust guide tube is generally circular and is provided with a cut-away portion corresponding to the profile of the orifice member.

31. An apparatus as claimed in claim 29 or 30 which includes an external exhaust outlet tube connected to a pump and extending to the secondary exhaust outlet and an opening between the secondary exhaust outlet and the outer exhaust tube, providing communication to atmosphere whereby a substantial constant atmospheric pressure is maintained in the ion source housing.

32. An apparatus as claimed in claim 31, which includes an intermediate exhaust tube extending from the secondary exhaust outlet, and wherein the opening is annular and is provided between the intermediate and outer exhaust tubes.

33. An atmospheric pressure chemical ionization source comprising:

a) a tubular ceramic body defining a substantially tubular flash desorption chamber, opened at one end and closed at the other end;

b) a supply tube extending through the closed end of the body to provide at least a spray of a liquid sample containing an analyte dissolved in a solvent liquid; and c) an electrical resistive heating element formed within the ceramic for heating the ceramic to a temperature sufficient to cause flash vaporization of droplets of the liquid sample.

34. An atmospheric pressure chemical ionization source as claimed in claim 33, wherein the ceramic body comprises a first, inner tubular layer, a thin film heater formed on the exterior surface thereof, and an outer cylindrical ceramic layer.

35. An atmospheric pressure chemical ionization source as claimed in claim 33, wherein the supply tube also includes a path for supply of gas for promoting vaporization of solvent liquid.

36. An atmospheric pressure chemical ionization source as claimed in claim 33, 34, or 35, wherein the supply tube is removable, and includes a nebulizer probe for insertion into the tubular ceramic body.

37. An atmospheric pressure chemical ionization source as claimed in claim 34, wherein the thin film heater comprises a first portion and a second portion, wherein the first portion is configured to have a higher watt density per unit area to provide a primary flash zone and a second portion, adjacent the open end, having a lower watt density to form a secondary flash zone.

38. A method of forming ions by atmospheric chemical pressure ionization, the method comprising:

a) providing a capillary tube with a free end for forming a spray from a liquid sample comprising a solvent liquid and an analyte dissolved therein;

b) providing a flow of a gas to promote evaporation of the solvent liquid;

c) providing a heated surface around the spray and heating the surface to a temperature sufficient to promote flash vaporization of liquid droplets and prevent substantial contamination of the heater surface by the Leidenfrost effect; and d) providing a corona discharge to ionize free analyte molecules.

39. A method as claimed in claim 38, which includes providing a primary flash zone adjacent the free end of the capillary, providing a first heat flux to the primary flash zone, providing a secondary flash zone downstream from the primary flash zone and providing a second, lower heat flux to the second flash zone.

* * * * *